US011186427B2

(12) United States Patent
Corbin et al.

(10) Patent No.: US 11,186,427 B2
(45) Date of Patent: Nov. 30, 2021

(54) CONTAINER FOR COMESTIBLE PRODUCTS

(71) Applicant: Maplehurst Bakeries, LLC, Brownsburg, IN (US)

(72) Inventors: Kristopher Frank Corbin, Zionsville, IN (US); Jacqueline Grimm, Zionsville, IN (US); Robert Blake Leftwich, Loveland, OH (US)

(73) Assignee: WF Bakery Inc., Toronto (CA)

( * ) Notice: Subject to any disclaimer, the term of this patent is extended or adjusted under 35 U.S.C. 154(b) by 107 days.

(21) Appl. No.: 16/266,364

(22) Filed: Feb. 4, 2019

(65) Prior Publication Data

US 2019/0241354 A1 Aug. 8, 2019

Related U.S. Application Data

(60) Provisional application No. 62/625,693, filed on Feb. 2, 2018.

(51) Int. Cl.

| | |
|---|---|
| ***B65D 85/36*** | (2006.01) |
| ***B65B 7/26*** | (2006.01) |
| ***B65B 25/00*** | (2006.01) |
| ***B65D 1/36*** | (2006.01) |
| ***B65D 43/16*** | (2006.01) |
| ***B65D 43/22*** | (2006.01) |

(52) U.S. Cl.

CPC ..... *B65D 85/36* (2013.01); *B65B 7/26* (2013.01); *B65B 25/005* (2013.01); *B65D 1/36* (2013.01); *B65D 43/162* (2013.01); *B65D 43/22* (2013.01); *B65D 2543/00203* (2013.01); *B65D 2543/00296* (2013.01); *B65D 2543/00361* (2013.01); *B65D 2585/363* (2013.01)

(58) Field of Classification Search

CPC ..... B65D 85/36; B65D 1/36; B65D 43/162; B65D 43/22; B65B 7/26; B65B 25/005

See application file for complete search history.

(56) References Cited

U.S. PATENT DOCUMENTS

| | | | |
|---|---|---|---|
| 3,591,041 | A | 7/1971 | Digrande |
| 3,794,090 | A | 2/1974 | Commisso |
| 4,038,807 | A | 8/1977 | Beardsley |
| 4,771,934 | A | 9/1988 | Kalmanides |
| 5,632,924 | A | 5/1997 | Gics |
| 6,176,375 | B1 | 1/2001 | Truscello |
| 6,231,906 | B1 | 5/2001 | Alessi |

(Continued)

*Primary Examiner* — Shawn M Braden

(74) *Attorney, Agent, or Firm* — Gutwein Law; Tyler B. Droste

(57) ABSTRACT

A container for storing a plurality of food items having a base portion with a peripheral edge at a base peripheral edge plane. The base portion can include a plurality of cavities with each cavity having an interior wall surface extending up a first axis from a cavity base wall. At least a first portion of the interior wall surface terminates at a cavity rim formed where the first portion of the interior wall surface intersects with the peripheral edge surface, wherein an exterior cavity rim portion can be formed by the plurality of cavities. An interior support member formed within the base portion can extend up from the base portion to a first plane above the peripheral edge plane. A lid support member can extend down from the top surface of the lid portion and contact the top surface of the interior support member.

18 Claims, 20 Drawing Sheets

(56) References Cited

U.S. PATENT DOCUMENTS

| | | | | |
|---|---|---|---|---|
| 9,216,849 | B2 | 12/2015 | Pham | |
| 9,592,951 | B2 | 3/2017 | Brummer | |
| 2009/0218347 | A1 | 2/2009 | Helou, Jr. | |
| 2013/0004625 | A1* | 1/2013 | Brummer | B65B 7/26<br>426/119 |
| 2018/0093800 | A1* | 4/2018 | Fosse | B65D 43/22 |
| 2019/0055081 | A1* | 2/2019 | Guirguis | B65D 43/162 |
| 2019/0308800 | A1* | 10/2019 | Muhlemann | B65D 1/36 |

* cited by examiner

CONTAINER FOR COMESTIBLE PRODUCTS

CROSS REFERENCE TO RELATED APPLICATIONS

This application claims priority to U.S. Provisional Patent Application No. 62/625,693 filed Feb. 2, 2018 to the above-named inventor and is herein incorporated by reference in its entirety.

FIELD OF THE INVENTION

This invention relates generally to packaging or a container for storing at least one food item and methods for storing, preparing, and packaging food items. More specifically, the invention relates to a food container, namely, a container for bakery products such as cupcakes, muffins, and other similar food items.

BACKGROUND

In the food packaging industry, various types of containers are used to package food items. These packages can be both rigid and semi-rigid in nature depending upon the product being packaged and the process used for manufacturing. Frequently, when containers are filled with food items, such as cupcakes, and are transported, the food items themselves can become misplaced or overturned during the transportation of the product to the retailer. It is nearly inevitable that with cupcakes having icing, that some of the icing will come into contact with an interior portion or walls of the container they are being stored in. Even more undesirable, is when a cupcake becomes dislodged from its prescribed cavity and is turned on its side, located upside down or misplaced within the package completely. These dislodgements can convey to the end consumer that cupcakes have been smashed or destroyed in transit and lead to the container not being purchased or thrown out by the retailer.

In general, the majority of containers for comestible products, specifically cupcake containers for multiple cupcakes have been adapted from a container originally for use as a salad container. The modifications over the years have improved upon the original container to allow for a better container for storing and transporting cupcakes but still has many limitations as it was not designed specifically for cupcake packaging. Some current packages attempt to help maintain the cupcake within its prescribed cavity using a hold down feature. While the present disclosure provides for a side hold down feature, various other elements of the present disclosure allow for ensuring that a cupcake is maintained in its prescribed cavity. Certain patents and patent applications including U.S. Pat. Nos. 6,176,375, 9,592,951, and 6,231,906 disclose different containers for food items including ways to reduce movement of the food items.

Additionally, many of the containers contain de-nesting lugs located at the corners near the sealing members of the packaging. The de-nesting lugs allow for the containers to be easily separated during the packaging process when the containers are located in the stack prior to being separate one, by one and then added to the manufacturing line. The location of these lugs on the corners of the container result in a weaker coupling between the top and bottom portions and less structural integrity. This requires the packaging to be closed using a vertically supplied force across the top surface of the container. This closing means can result in inconsistent closing of the container and coupling between the top and bottom portion. It also creates an inefficiency in the packaging process because a separate step is necessary as the containers are transported down the assembly line. Because of these de-nesting lugs pressure is first required in the machine direction, and then the package stops on the line where two mechanisms then transfer across perpendicularly in the attempts of closing both the lead and trail edge of the container. This stop and go then results in slower production line speeds and can also result in false closure.

There exists a need for an improved container for comestible products to maintain the comestible products in its prescribed location within the container, as well as, preventing unfavorable leaning food items within the container after the container has been moved, inverted, or jostled during transportation. Additionally, there exists a need for an improved container configured to inhibit the movement of food items within the container, while also ensure a more efficient and practical means for sealing the containers.

BRIEF SUMMARY OF THE INVENTION

In one aspect, this disclosure is related to a container for storing a plurality of food items, comprising a base portion having a peripheral edge at a base peripheral edge plane. The base portion can include a plurality of cavities in the base portion, each cavity having an interior wall surface extending up a first axis from a cavity base wall, wherein at least a first portion of the interior wall surface terminates at a cavity rim formed where the first portion of the interior wall surface intersects with the peripheral edge surface, wherein an exterior cavity rim portion can be formed by the plurality of cavities. A lid portion can be configured to removeably couple to the base portion, wherein the lid portion has lid peripheral edge at lid peripheral edge plane, an upper lid surface, and a lid sidewall extending down an axis from the upper lid surface to the lid peripheral edge. An interior support member formed within the base portion can extend up from the base portion to a first plane above the peripheral edge plane. A lid support member can extend down from the top surface of the lid portion and contact the top surface of the interior support member.

In another aspect, this disclosure is related to method of packaging food items in a container having de-nesting lugs, comprising providing a plurality of containers having a lid portion and a base portion, wherein the lid portion has a plurality of de-nesting lugs within a recess proximate to the peripheral edge of the container, wherein the de-nesting lug does not come into contact with the peripheral edge of the lid portion. A food item can then be provided within one or more cavities in the container. The package can then be sealed using a line conveyor continuous sealing means such as a minimizer to ensure a closure at the peripheral edge of the package using continuous movement. The container can include recesses having corresponding de-nesting lug. The container can further include an interior support member extending up from the base portion to an interior support member plane and a portion of the interior support member forms a part of the interior cavity wall, wherein the interior support member plane is above a peripheral edge plane and configured to maintain the food item within the cavity and inhibit the movement of the food item from moving out of the prescribed cavity of the food item.

BRIEF DESCRIPTION OF THE DRAWINGS

The following description includes discussion of figures having illustrations given by way of example of implementations of embodiments of the invention. The drawings should be understood by way of example, and not by way of limitation. As used herein, references to one or more "embodiments" are to be understood as describing a particular feature, structure, or characteristic included in at least one implementation of the invention. Thus, phrases such as "in an exemplary embodiment" or "in an alternate embodiment" appearing herein describe various embodiments and implementations of the invention, and do not necessarily all refer to the same embodiment. However, they are also not necessarily mutually exclusive.

The features and advantages of this disclosure, and the manner of attaining them, will be more apparent and better understood by reference to the following descriptions of the disclosed system and process, taken in conjunction with the accompanying drawings, wherein.

DETAILED DESCRIPTION OF THE INVENTION

Figure 1A:
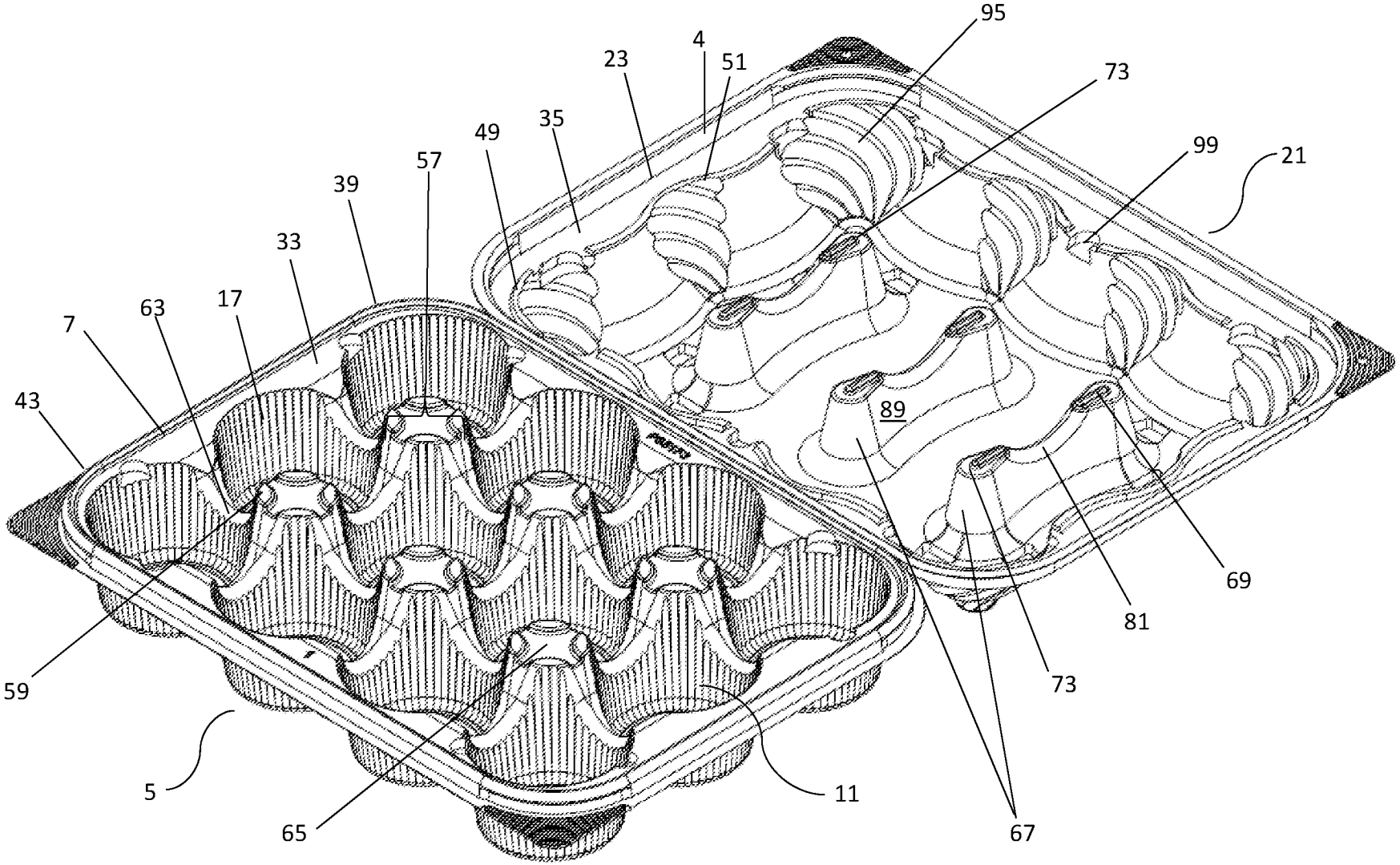
FIG. 1A is a perspective view of an exemplary embodiment of a container of the present disclosure have the lid portion open from the base portion.

The following detailed description is of example embodiments with references to the accompanying drawings. Such description is intended to be illustrative and not limiting with respect to the scope of the possible embodiments. Such embodiments are described in sufficient detail to enable one of ordinary skill in the art to practice them, and it will be understood that other embodiments may be practiced with some variations.

As illustrated in FIGS. 1-9, an improved container 1 for storing food items 3 such as a cupcake can include a base portion 5 and a top portion 21. The base portion 5 can include a base peripheral edge 7 located on a base peripheral edge plane 9. A plurality of cavities 11 can be defined within the base portion 5. The cavities 11 can include an interior wall surface 13 extending up from a cavity base wall 15. The cavity base walls 15 of the various cavities 11 can define the bottom surface of the base portion 5. In one exemplary embodiment, the base portion 5 can have twelve cavities 11 in a 3×4 configuration formed in the base portion 5.

A first portion of the base cavity interior walls 13 that extend up in a general vertical plane from the base wall 15 can intersect with the base peripheral edge surface 33 to form a rim around the edge of the base exterior of the base and form a continuous exterior cavity rim portion 31 that can generally proximate the exterior of the base portion of the container. This first portion 17 can primarily be located on the exterior faces of the cavities 11.

The base portion can further comprise one or more interior support members 57 formed in base portion 5. The interior support members 57 can extend up from the bottom surface of the base portion 5. These interior support members 57 can be formed by second portion 56 of interior walls can extend generally upward along a vertical plane to the lid support member plane. In some embodiment, the interior support members 57 can have a top surface 59. The top surface 59 can extend upward from the base surface past the base peripheral edge plane 9.

In some embodiments, the interior support members 57 can form a portion of the interior wall surface 13 cavity wall. The portion of the interior support members 57 that form the interior wall surface 13 can be configured to maintain a food item, within its designated cavity 11. The interior support member(s) can extend beyond the base peripheral edge plane 9 and terminate at a lid support member plane 71. The lid support member plane 71 can located a pre-determined distance above the base peripheral edge plane 9. A portion of interior wall surface 13 that is part of the lid support member 57 can extend to the lid support member plane 71. This helps to maintain the food item 3 within its prescribed cavity 11 and prevent and/or inhibit lateral and vertical movement of the food item 3, as well as, limit or inhibit the tipping of the food item 3 within its prescribed cavity 11. The interior support member extending above the edge plane 9 can aid in prevent unwanted movement of a food item within a cavity 11 of the base portion 5 and can ensure a food item remains in an upright position within the food item's prescribed cavity 11.

Optionally, a third portion 61 of the cavity interior wall 13 can terminate prior to extending up to the base peripheral edge plane 25 to form a recessed portion 61 of the interior wall 13. The recessed portion 61 of the cavity wall can still maintain separation between the plurality of cavities 11. Additionally, the recessed portion 61 can allow a user easier access to add or remove a food item 3 from the cavity 11. In some embodiments an intermediate portion 63 can be formed in between each of the cavities 11. The intermediate portion can be a pre-determined width formed in between cavities to maintain adequate separation of the food items 3 within the container.

The interior support members 57 can be formed by part of the intermediate portions 63 between cavities 11. Similarly, the intermediate portions 63 can span between two interior support members 57 or between an interior support member 57 and a portion of the cavity rim 19 or base peripheral edge surface 33. In embodiments, the top surface 59 can further include one or more grooves/channels 65 configured to accept or retain a first portion 69 of lid support member 67. One or more channels can optionally intersect each other to form a cross or "X" shape, as shown in FIG. 1A. The multiple channels 65 can allow for movement of the first portion 69 of the lid support member 67 when a force is applied to the lid surface. The movement can be restricted by the channel(s) 65 so as to not allow the lid support member(s) 67 to extend below the interior support member plane 71. Similarly, this prevents the bottom surface 73 of the lid support member(s) 67 from coming into contact with the food item in the cavity 11 when a force is applied to the top of the container 1 or lid portion 21. In one exemplary embodiment shown in FIG. 1B, a lid portion 21 can have six lid support members wherein two support members are each coupled together by a bridge portion 81 form three lid cavities 85 in the upper surface 27 of the lid portion 21. In one exemplary embodiment, the base portion 5 can have six interior support members 67. In some embodiments, the three cavities 85 can be considered three elongated support member 67 wherein a bridge portion 81 connects the two support members 67. It should be understood depending upon the number cavities 11, the number of lid cavities 85 may vary.

A base peripheral edge surface 33 can extend between the cavity rim 19 and the base peripheral edge 7 along the base peripheral edge plane 9. In some exemplary embodiments, a coupling means 37 can include a base sealing member 39 and a lid sealing member 41. The base sealing member 39 can be located on at least a portion of the base peripheral edge 7. In some exemplary embodiments, the base sealing member 39 can be located around the entire perimeter of the base peripheral edge 7. Similarly, the lid sealing member 41 can be located on at least a portion of the lid peripheral edge 23. Optionally the lid sealing member 41 can be located on the entire lid peripheral edge 23.

Figure 3A:
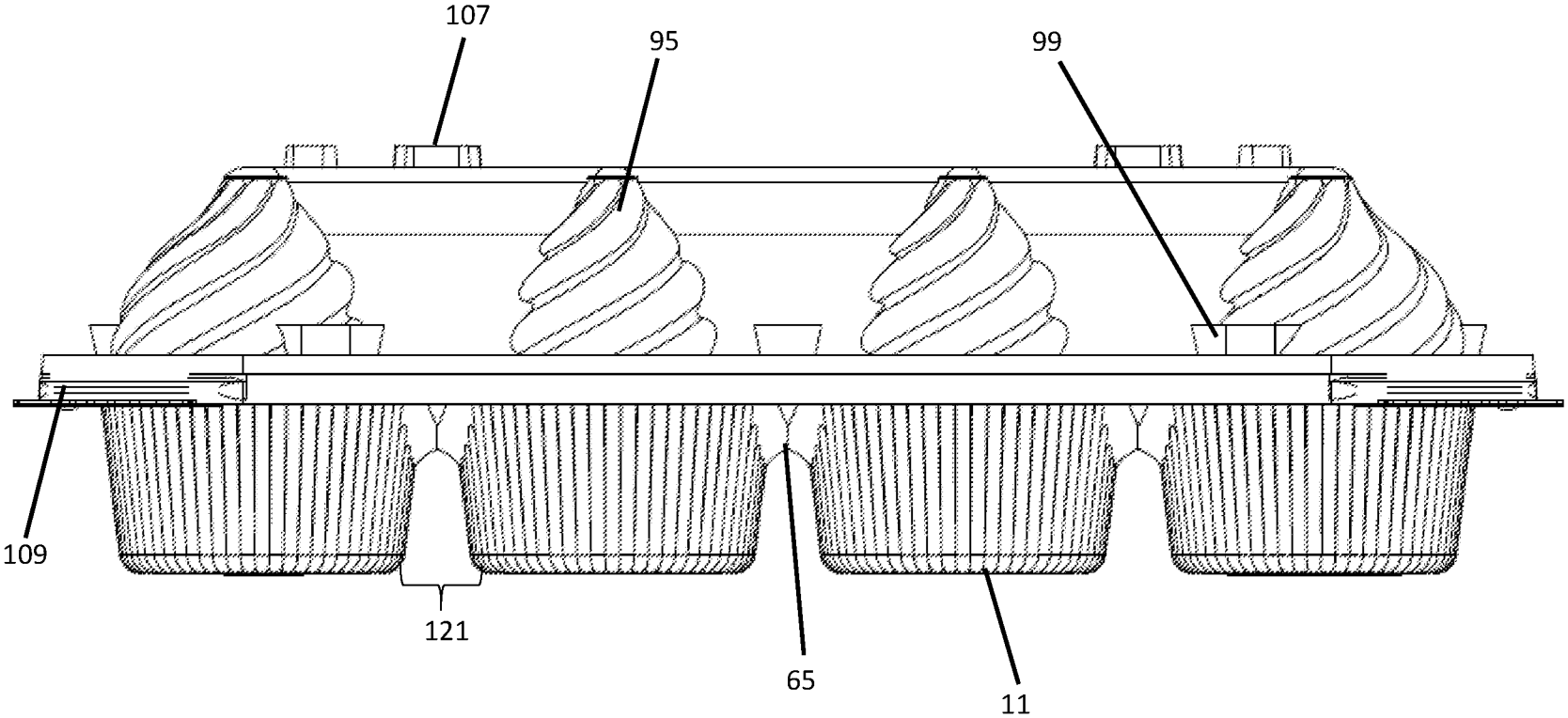
FIG. 3A is a side view of an exemplary embodiment of a container of the present disclosure.
Figure 3B:
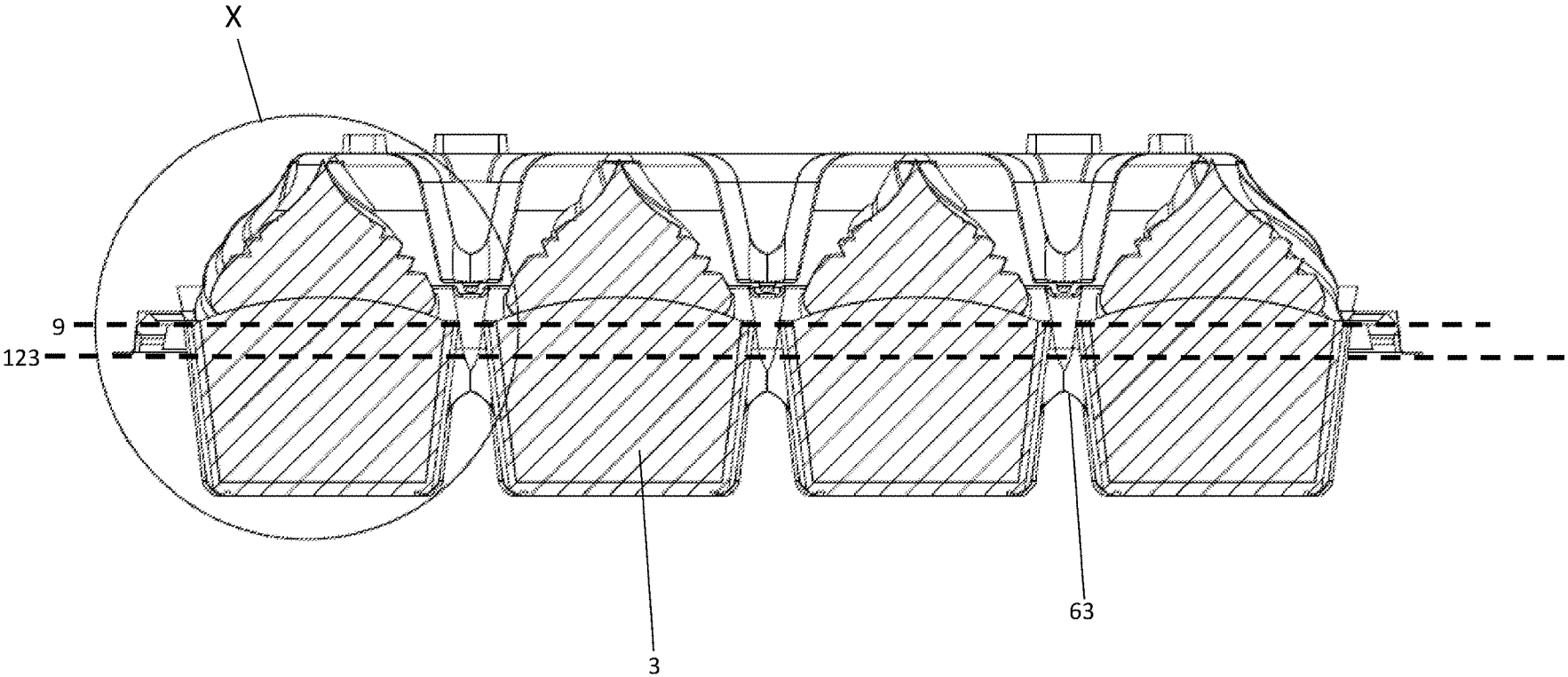
FIG. 3B is a cutaway side view of an exemplary embodiment of a container of the present disclosure along line A-A of FIG. 2.
Figure 3C:
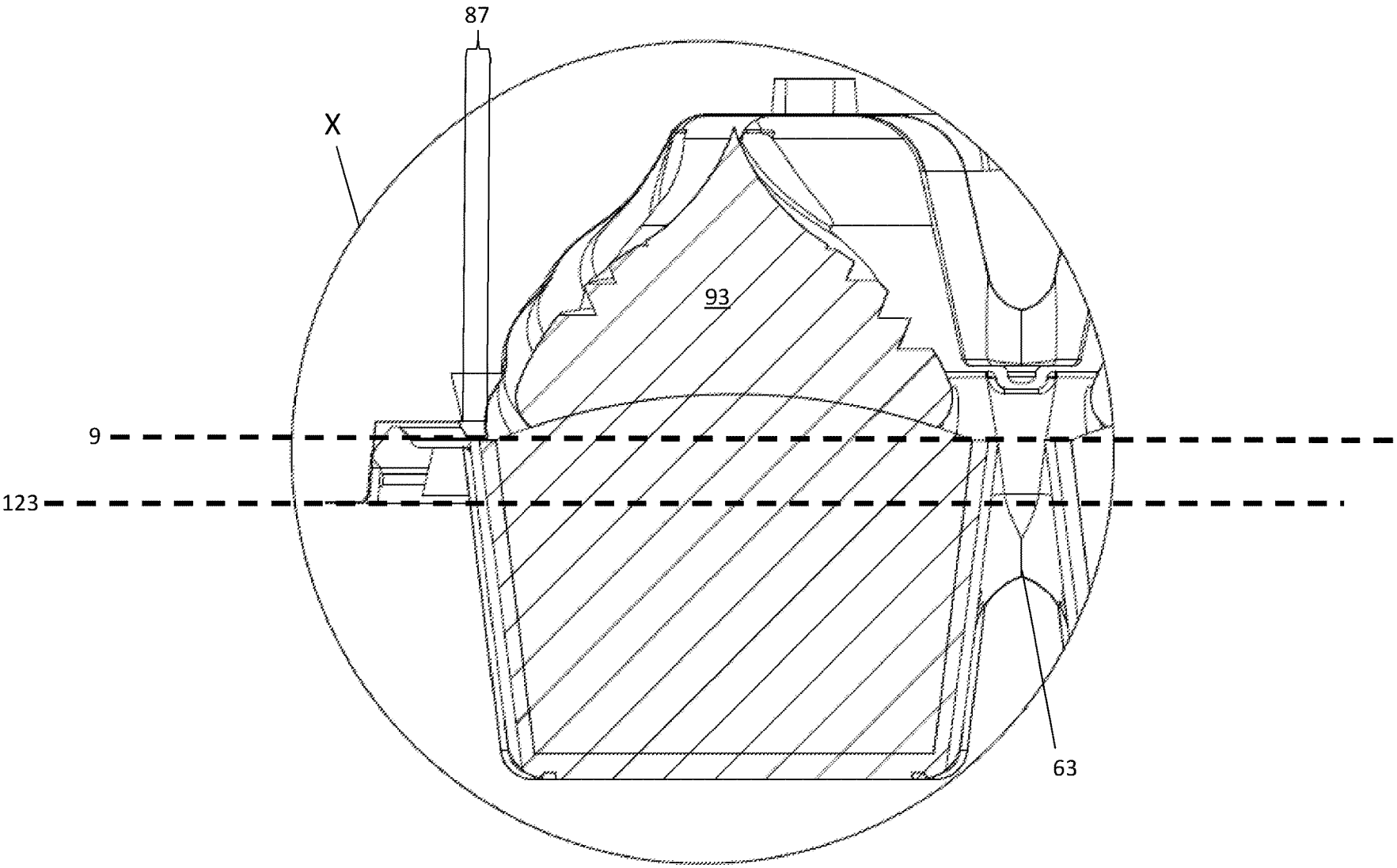
FIG. 3C is an enlarged view of detail area X of FIG. 3B.
Figure 3D:
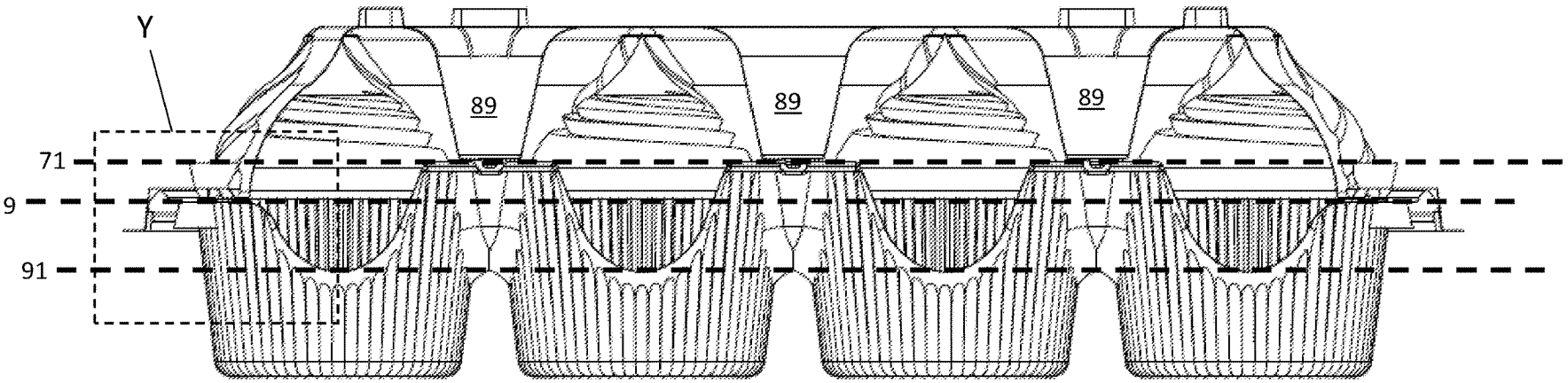
FIG. 3D is a cutaway side view of an exemplary embodiment of a container of the present disclosure along line B-B of FIG. 2.
Figure 3E:
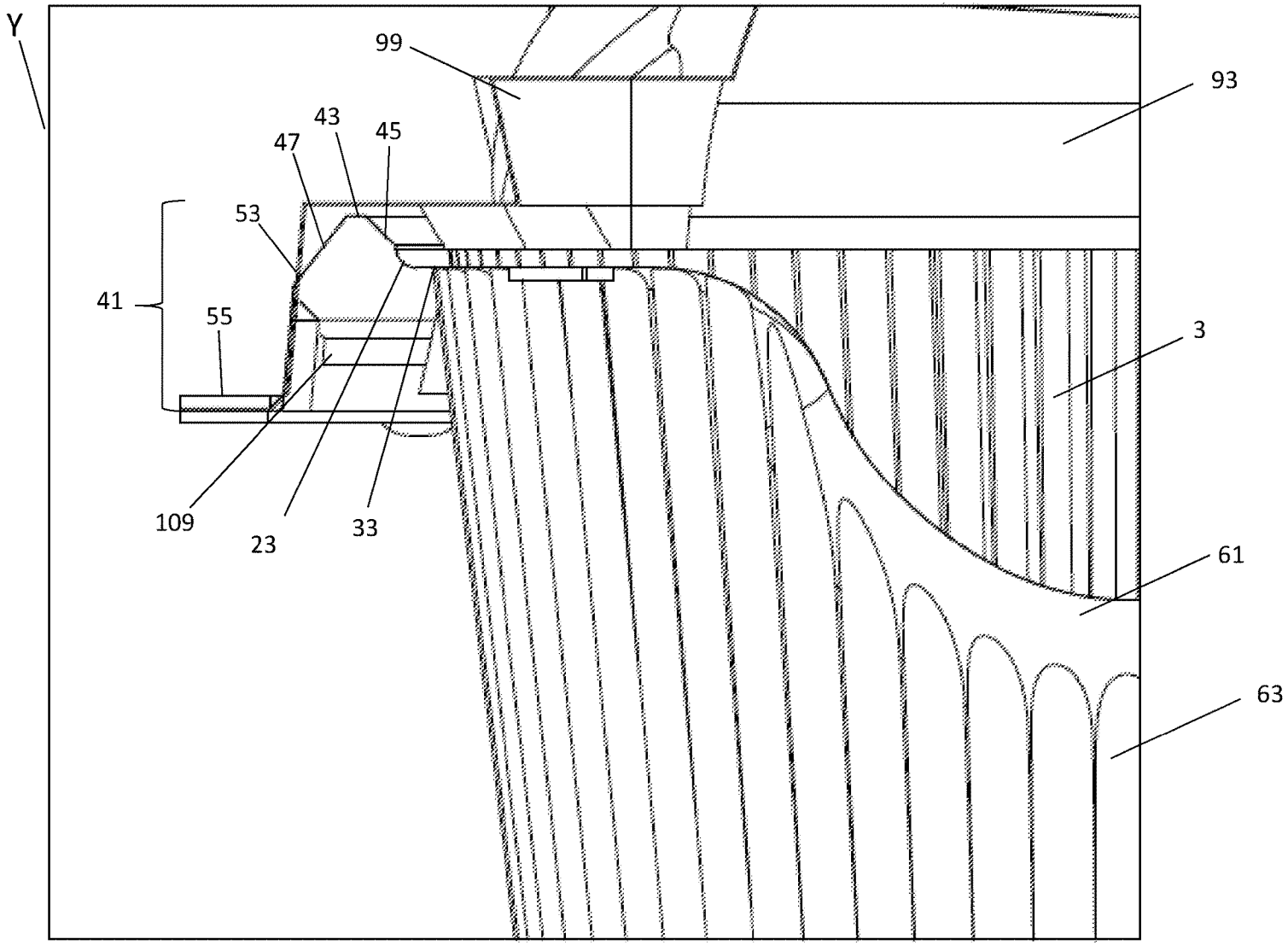
FIG. 3E is an enlarged view of detail area Y of FIG. 3D.
Figure 4:
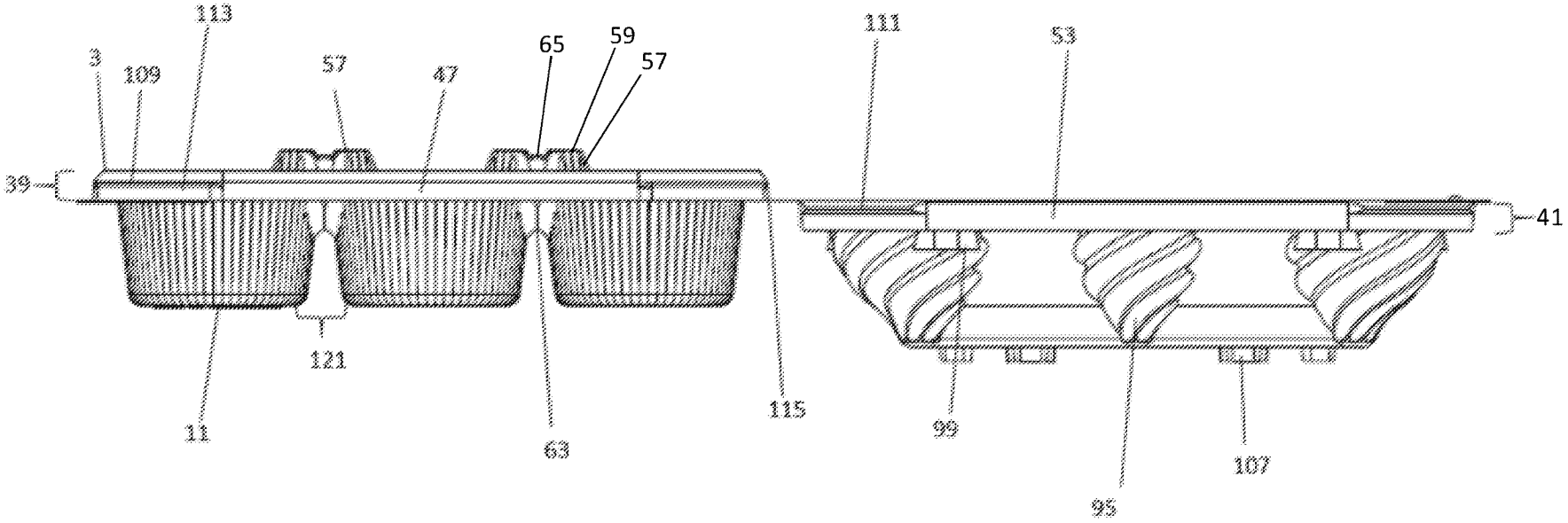
FIG. 4 is a side view of an exemplary embodiment of a container of the present disclosure wherein the lid portion hingedly connected and open from the base portion.
Figure 5:
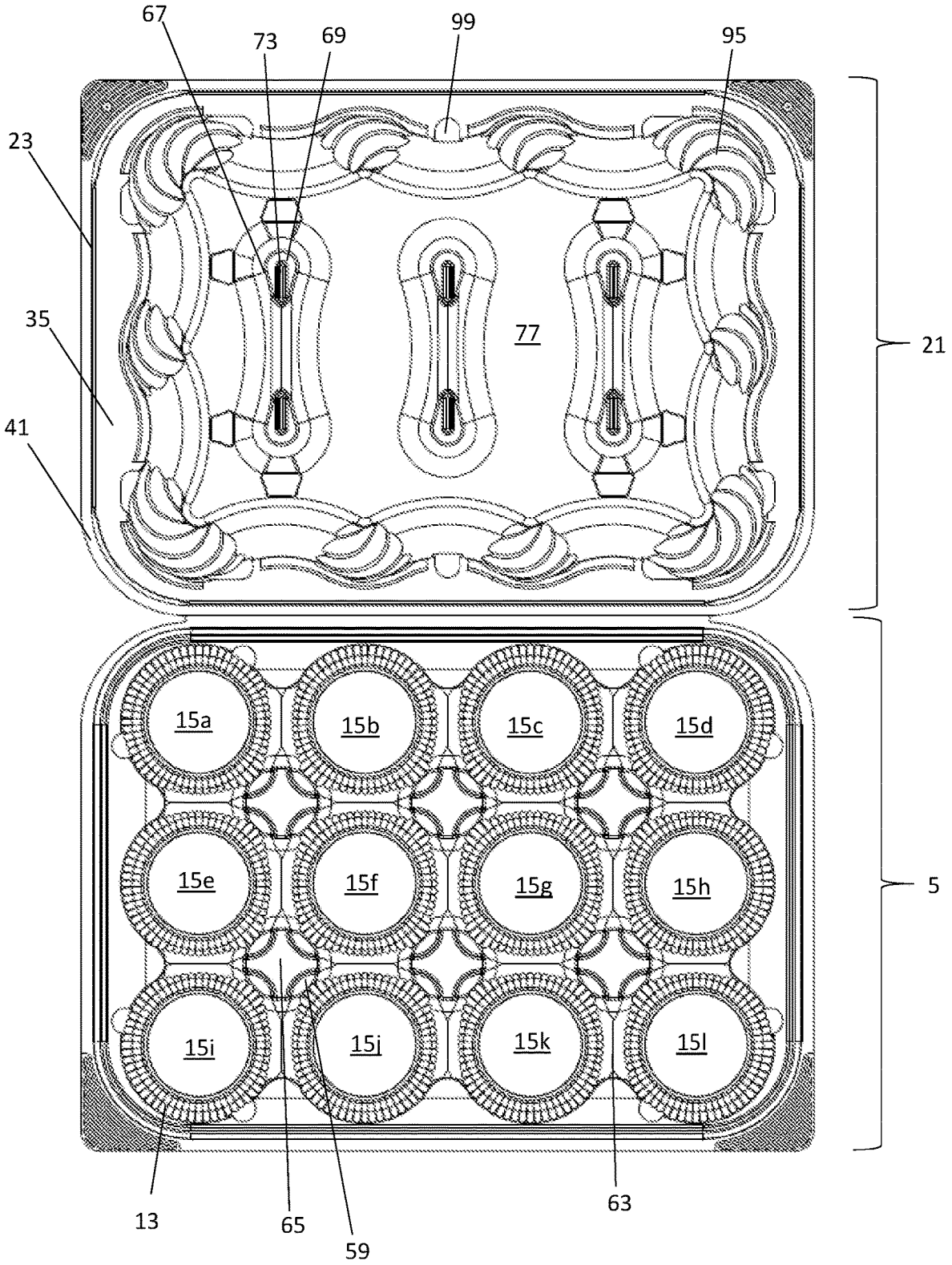
FIG. 5 is a top view of an exemplary embodiment of a container of the present disclosure wherein the lid portion hingedly connected and open from the base portion.
Figure 7A:
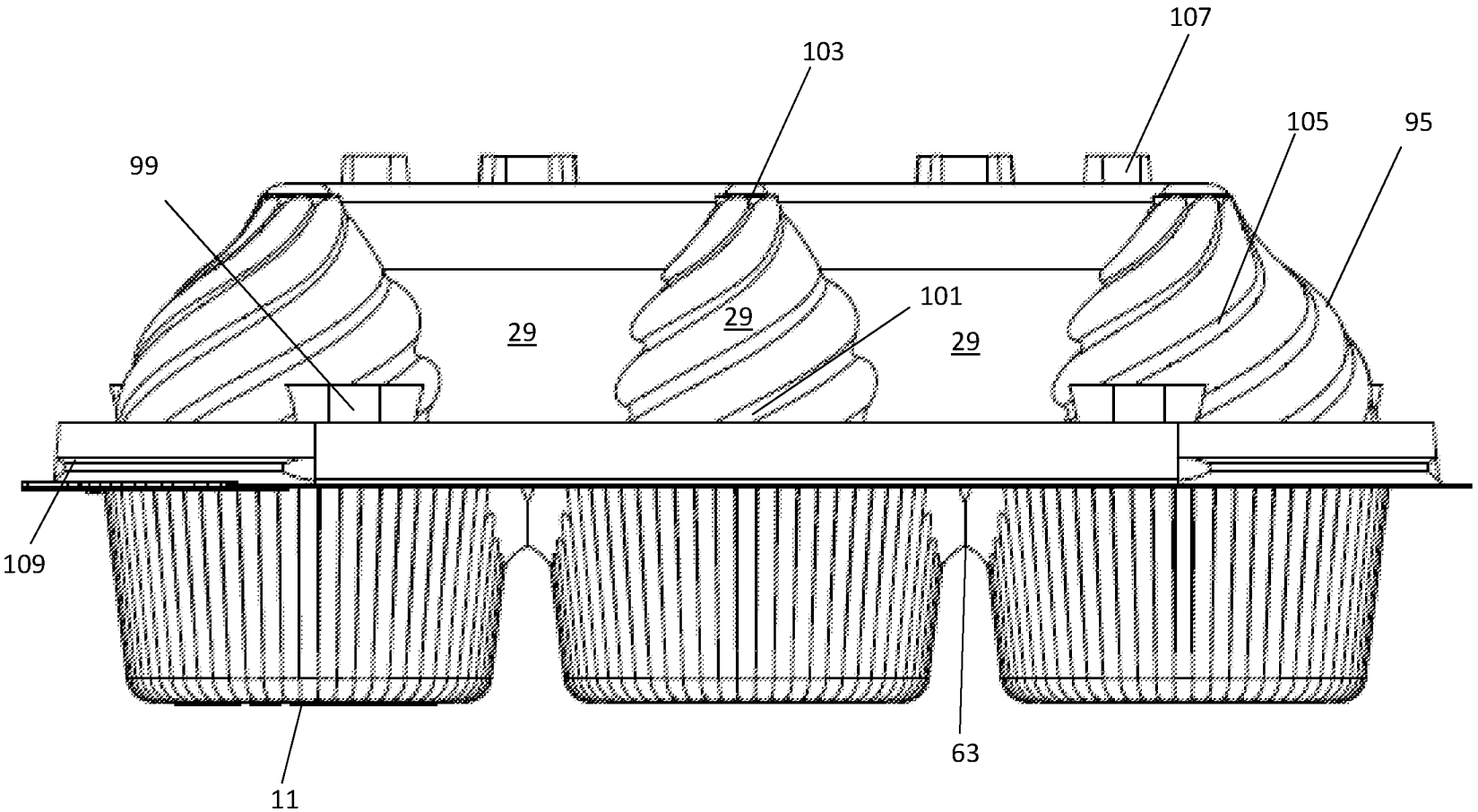
FIG. 7A is a side view of an exemplary embodiment of a container of the present disclosure wherein the lid portion coupled to the base portion.
Figure 7B:
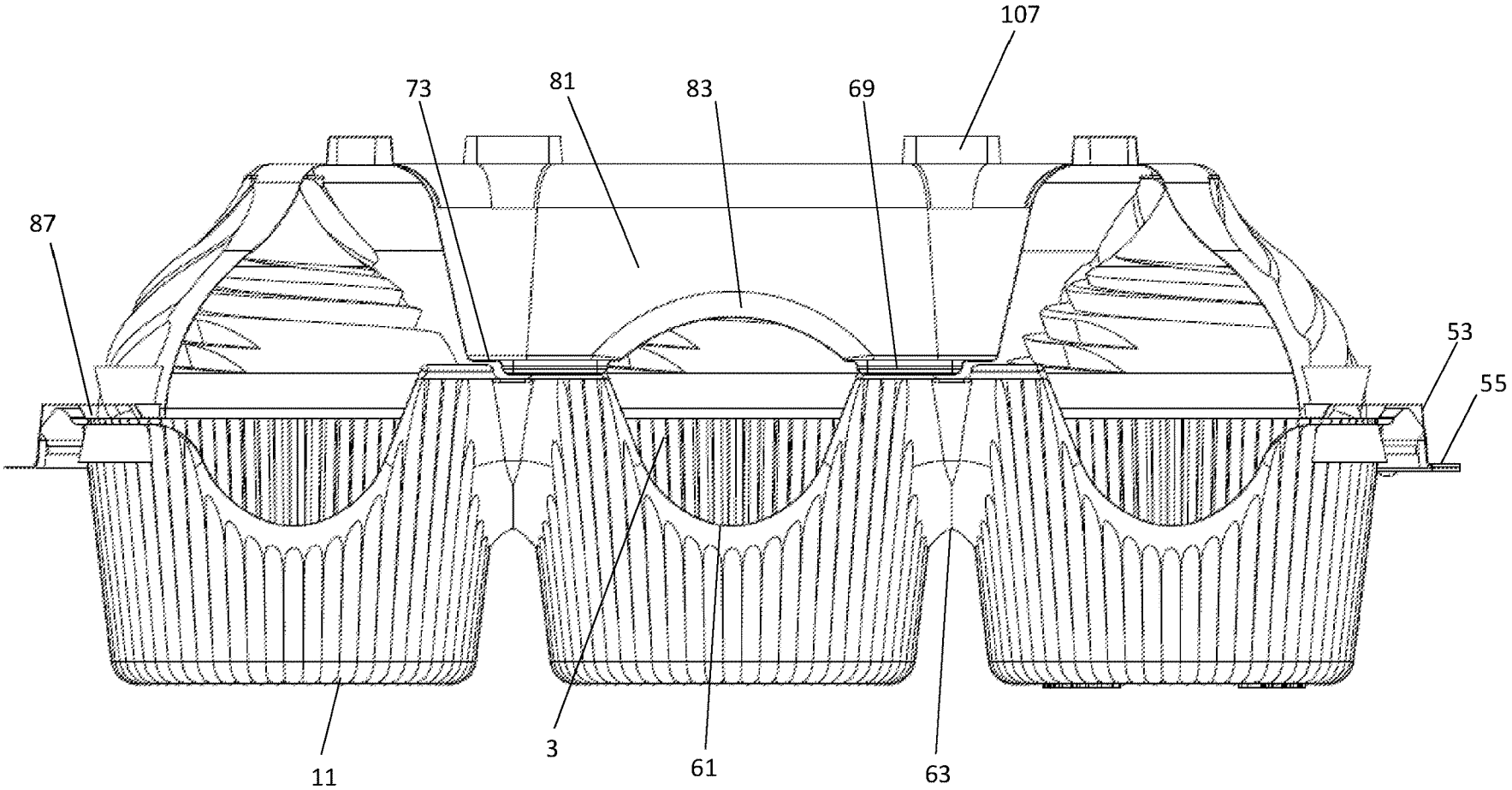
FIG. 7B is a cutaway side view of an exemplary embodiment of a container of the present disclosure along line C-C of FIG. 2.
Figure 7C:
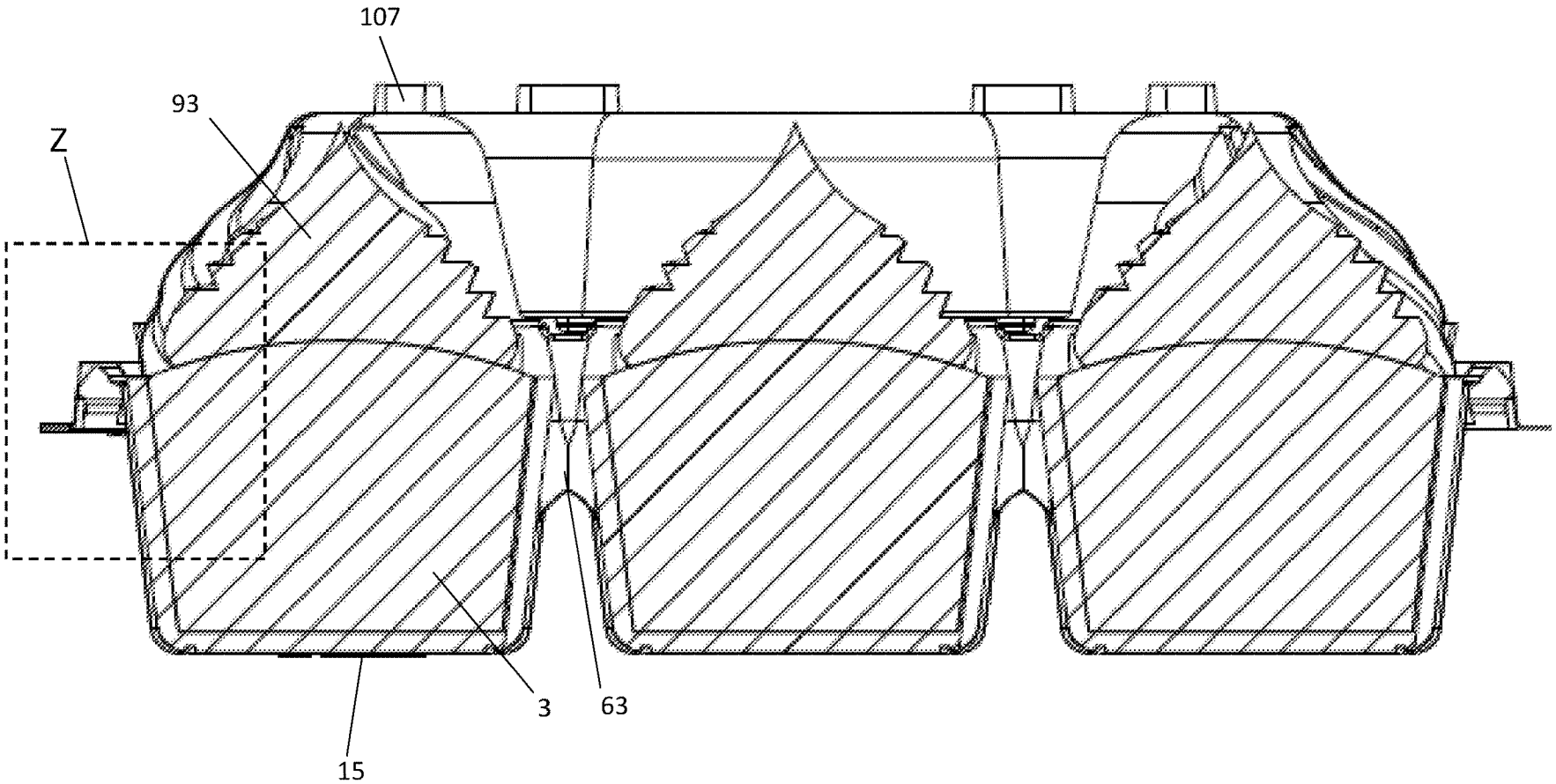
FIG. 7C is a cutaway side view of an exemplary embodiment of a container of the present disclosure along line D-D of FIG. 2.
Figure 7D:
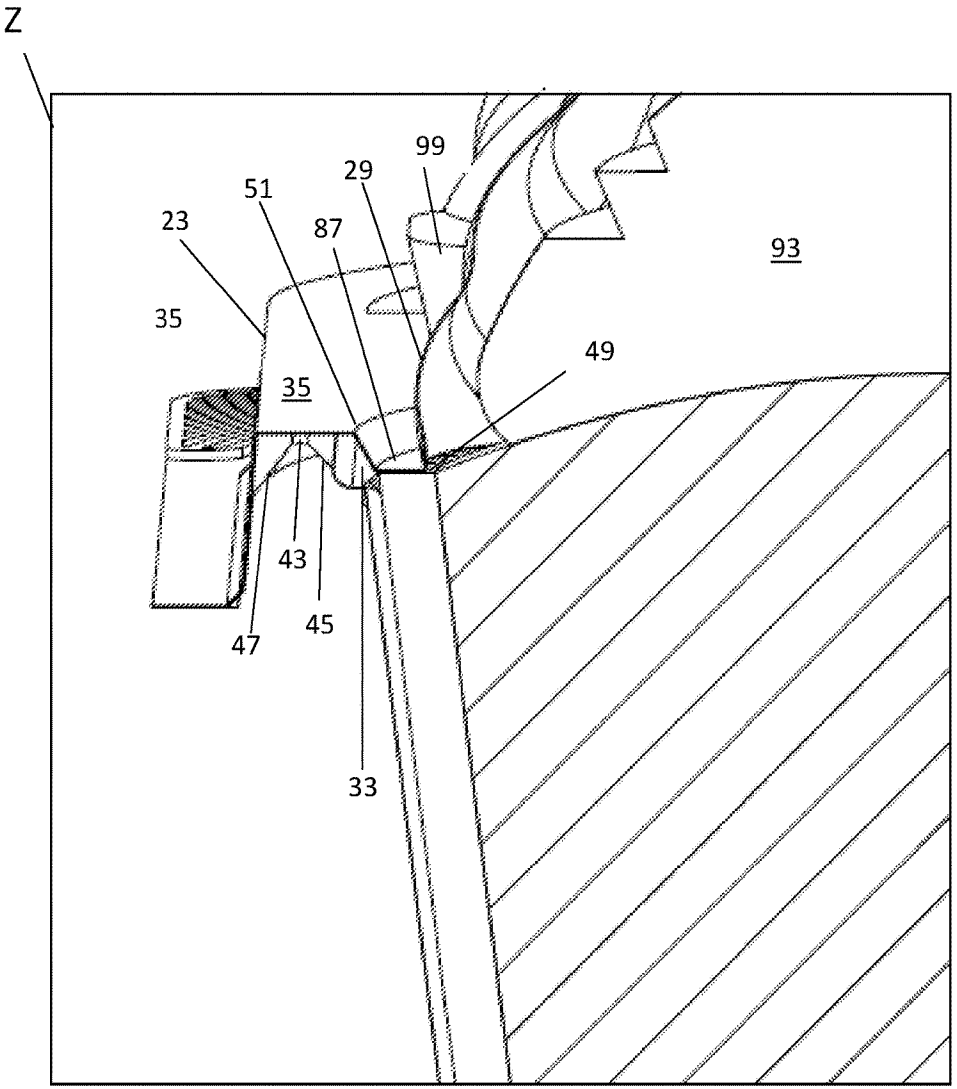
FIG. 7D is an enlarged perspective view of detail area Z of FIG. 7D.

In some embodiment, the coupling means 37 including the base sealing member 33 and lid sealing member 41 can approximate the shape of the other. A first portion 45 of the base sealing member can initially extend upward along an axis from the base peripheral edge 9 from a lip 43 located at the base peripheral edge 7. A second portion 47 of the base sealing member 39 can then extend down from the lip 43. The second portion 47 above, at, or below the base peripheral edge plane 9. In one exemplary embodiment, the second portion 47 can extend below the base peripheral edge plane 9, as shown in FIGS. 3E and 7D. Unlike previous embodiments, the lip of the coupling means can be located at a plane below the interior support member plane 71.

Similarly, the bottom edge of the base sealing member 39 and the bottom edge of the lid sealing member 41 of the coupling means 37 can be located below the plane of the cavity rim 19 and/or the base peripheral edge plane 9. In one exemplary embodiment illustrated in FIG. 3B, the bottom edge of the coupling means 37 can be at a plane 123 below the peripheral edge plane 9. Alternatively, the package can have a similar coupling means to previous embodiments that do not have the reduced height coupling means features. By substantially shifting the majority of the coupling means 37 to be formed below the plane of the cavity rim 19 and/or the base peripheral edge plane 9, more of the top portions, such as the iced or decorated portions 93 of the food items 3, can be exposed and allow for a consumer to better view the product within the package when in a closed orientation.

By reducing/lowering the height of the coupling means relative to the plane of the cavity rim 13 and or the base peripheral edge plan 9, the lid is better able to display and show the contents within the container/package. This can enhance and improve the visibility of the product or food item within the cavity to the consumer and result in improved product and brand equity. A consumer would be able to better evaluate the product within the container visually without the need of opening the package. In some embodiments, the lip 43 can be located at the same plane as the peripheral edge plane 25. By having the coupling means 37 at or near the peripheral edge plane 25, the base sealing member and lid sealing member are able to better maintain a sealing relationship. Also, the reduction of material above the peripheral edge plane result in a sturdier container 1 and coupling means 27 resulting in easier manufacturing and limited movement between the sealing members not found in previous containers. In some embodiments the lip 43 can extend no more than about 0.3" above the peripheral edge plane 25. The reduction of the coupling means height and location above the peripheral edge plane results in a better view angle and showcase of the food items 3 within the container 1.

The coupling means can also comprise a groove feature 109. The groove feature 109 can be located at any point of the coupling means and in multiple locations along the coupling means. In some embodiments, the groove feature 109 can extend around the entire peripheral edge of the coupling means 37. The groove feature can be formed by a lid groove 111 and a base groove 113. The lid groove 111 can be formed on a portion of the first portion of the lid sealing member 53 and the base groove 113 can be formed on a portion of the second sealing portion of the base sealing member 47, wherein the lid groove 111 fits within the base 113 to further provide a sealing relationship between the two sealing members. In some exemplary embodiments, the groove feature 109 can be located at each of the corners of the container 1.

Figure 6A:
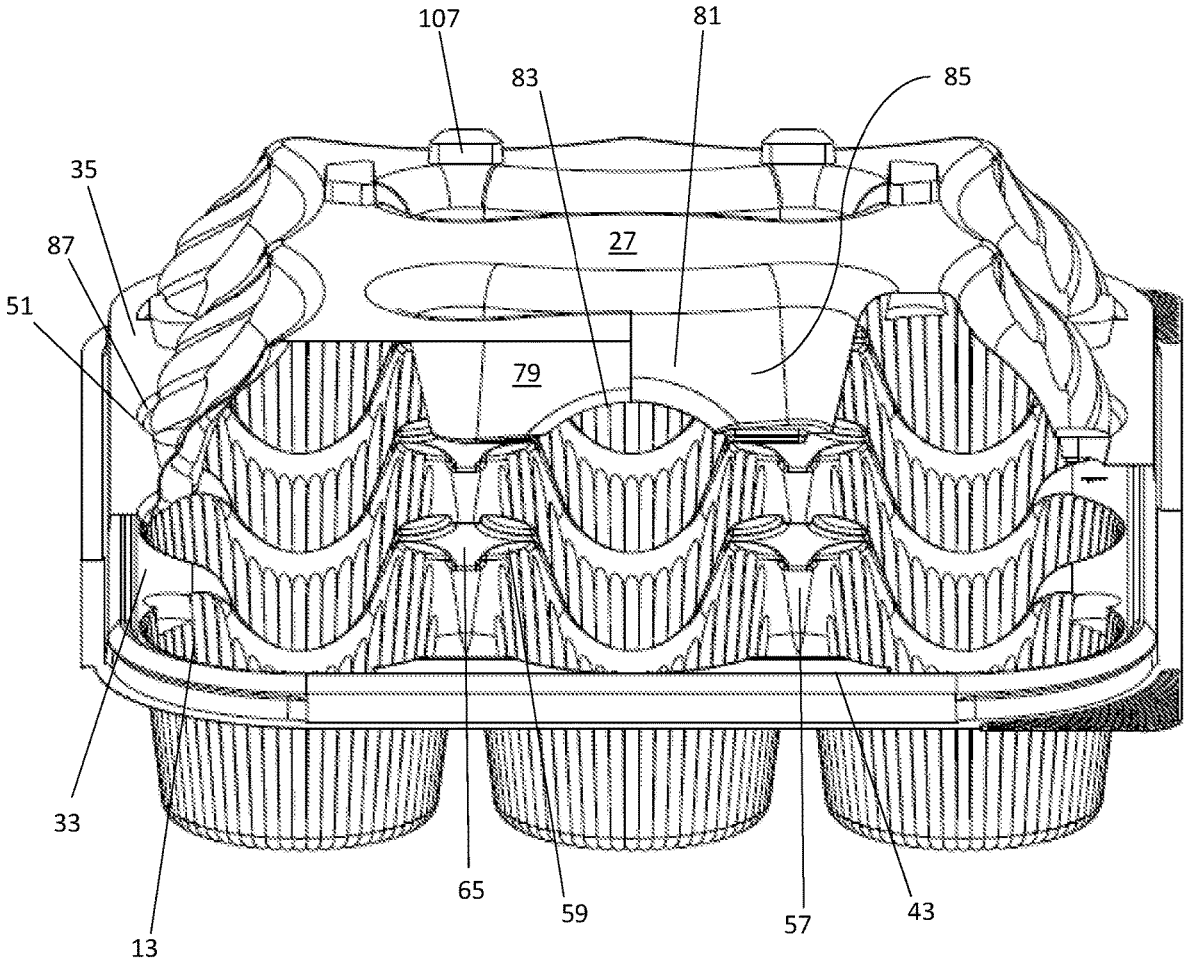
FIG. 6A is a perspective view of an exemplary embodiment of a container of the present disclosure with the lid portion closed on top of the base portion having a cutaway of a portion of the lid portion.
Figure 6B:
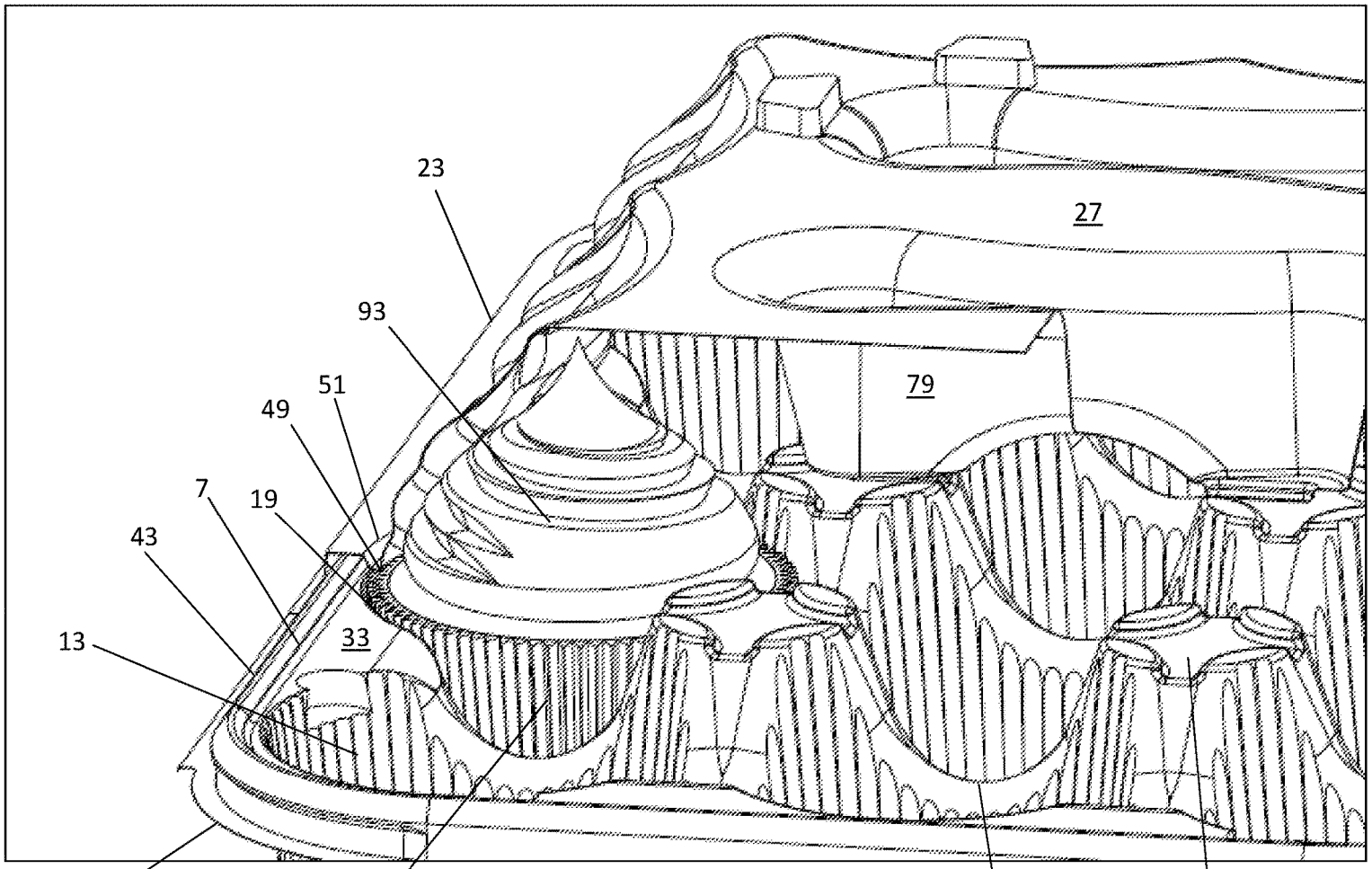
FIG. 6B is an enlarged view of FIG. 6A having a food item.

The lid portion 21 can include a lid peripheral edge 23 located on at the lid peripheral edge plane 25. The lid peripheral edge surface 35 can extend on a planar axis from the lid sidewall 29. In some embodiments, an internal peripheral lip edge 49 can be formed between the lid peripheral edge 23 and the lid sidewall 29. The internal peripheral lip edge 49 can protrude below the lid peripheral edge plane 25 and/or extend outwardly over a cavity rim 19, wherein the internal peripheral lip edge 49 can be configured to restrict the movement of a food item 3 within the cavity 11. In other embodiments, the internal peripheral lip edge 49 can also form a portion of a channel 87 on the exterior surface of the lid portion. The lid peripheral edge surface 35 can extend from the upper channel edge 51 of the channel 87 and extend on an axis from until terminating at the edge surface 35 to form the lid peripheral edge 21. As shown in FIG. 6B, the internal peripheral lip edge 49 of the formed channel 87 can overly a portion of the food item 3 to provide a securing feature to help limit or inhibit the movement of the food items within the base portion cavities 11. This channel 87 can run along the entire peripheral edge and provide a securing feature to all of the food item located on the exterior cavities 11 on all sides of the container.

Extending from the lid peripheral edge 21 can be the lid sealing member 41. A first portion 53 of the lid sealing member 41 can extend downward from the lid peripheral edge 23. In some embodiments, a second portion 55 of the lid sealing member 41 can extend horizontally planar from the first portion 53 of the lid sealing member 41. The lid peripheral edge plane 25 can be located just on top of the base peripheral edge plane. When the coupling means 37 is closed, the base sealing member 39 and the lid sealing member 41 couple together to maintain a sealing relationship between the lid portion 21 and the base portion 5. The lid sealing member 41 and base sealing member 39 can approximate one another around at least a portion of the peripheral edges of the container. In some exemplary embodiments, the coupling means can approximate the entire edge of the container 1.

The lid portion 21 can further include one or more lid support members 67 that extend downward from the top surface of the lid portion 21. The lid portion 21 can have an exterior surface 75 and an interior surface 77. The lid support member(s) 67 extending down from the top of the lid portion. The lid support member 67 can have a side wall 79 and a bottom surface 73, wherein the side wall 79 extends between the top surface 27 and the bottom surface 73. The side walls 79 can extend down from the top surface along an axis. In some embodiments, the lid support member(s) can approximate the shape of a food item within the cavity.

Similarly, the bottom surface 73 of a portion of the lid support member 67 can approximate the interior support member top surface. In some embodiments, the lid support member 67 can span across two interior support members to form a bridge portion 81. The bridge portion 81 can span across two lid support members 67. The bridge 81 can be formed by the side wall 79 extending down from the lid surface. The lid support member 67 can have dual functions for both providing additional stability of the lid when containers are stacked, or weight is applied to the top of the lid to prevent the lid from crushing. Similarly, the lid support members can be configured to maintain the food items 3 within their prescribed cavities 11 and from tipping within the cavity 11. Similarly, the internal support member 67 can provide internal separation between the food items and control movement of food items 3 within the container 1. In some embodiments, the bottom surface 73 of the lid support member can extend past the edge of the top surface of the lid portion. In this embodiment, the bottom surface can overly a portion of above the cavity. The portion that overlies the cavity can aid in maintain the food items within their cavities, as well as inhibiting or limiting their movement within the container. In one exemplary embodiment, each cavity can have an individual lid support member 73 that can extend down and overly a portion of a single cavity. In another exemplary embodiment, a secondary member from the lid support member 73 can extend down and overly a portion of the cavity to help maintain the food items position within the cavity.

In some exemplary embodiments, the bottom surface can have a 73 an extension portion 69 extending out from the bottom surface 73. The extension portion can be configured to fit within the top surface groove/channel 65 of the interior support member 57. Optionally, in some exemplary embodiment, the portion 69 and groove/channel 65 can be configured to removeable couple to each other to further maintain the closure of the lid portion 21 to the base portion 5. A separate retainer piece could also or alternatively be coupled to the portion 69 or channel 67. The retainer piece can be removeable couplable to the container 1. The retainer piece could extend past the edge of the top surface 59 of the interior support members and overlie a portion of one or more cavities 11. The retainer piece could extend past the cavity rim 19 and engage or be proximate to the top of food item within the cavity to inhibit or minimize movement of the food item.

The bridge 81 can have an arched portion 83 located in between the lid support members. The arched portion 83 can overly one of the intermediate portions 63 spanning between two interior support members 57 of the base portion 5. The arched portion 83 can be configured to add additional rigidity to the lid support member(s) 67. This provides additional structural rigidity to prevent crushing of the lid during transportation and storage of the package. Additionally, the arched portion can be raised above the plane of the interior support member plane. The arched portion 83 can help limit or prevent the bridge portion 81 from contacting a portion of the food item 3 when the food item is rested within the cavity 11. The lid support members may generally be identical to one another and include similar features, such as the first portion on the bottom surface of the lid support member 67 to fit within channel/groove 65 formed on the top surface of the interior support member 57. In other embodiments, the lid support members 67 can be separate from each other and not be connected by a bridge portion 81 between to support member 67.

From the upper lid surface 27, the lid support members can form a cavity 85 within the upper lid surface 27. In some exemplary embodiments, the upper lid surface 27 can still be primarily planar with one or more cavities 85 formed by the lid support member(s) 67. The cavity 85 can have a cavity wall 89 that extends down to the bottom cavity 85. The cavities can have any suitable shape that corresponds to the lid support members 67. In some exemplary embodiments, the cavities 85 can have a shape similar to a figure eight or hour class. Primarily, the shape is dictated by the configuration and number of cavities 11 for the food items. The lid support member side wall 79 can approximate the corresponding cavity rim 19 or intermediate portion 63 below.

Additionally, in some exemplary embodiments, the cavity wall 89 can be configured to conform to and proximate the shape of the food item 3 and icing portion 93 of the food item. The lid support members 67 can be configured in a way to maintain a food item 3 in its designated cavity 11 by minimizing the head space between the top of the food item at the interior top surface of the lid portion. In some exemplary embodiment, the space between the icing portion and the interior sidewall 79 of the support member 67 or bridge portion 81 can be less between about 0.1" inches and 1", about 0.2" and about 0.8", or less than about 0.5", or less than about 0.2". FIG. 7*b* illustrates a cutaway view showing the interior surface 77 of the lid support member side wall 79 approximating the shape of the foot item, including the icing portion 93 of the food item 3. In some exemplary embodiment, the bottom surface of the lid support member 73 can extend and overly a single cavity 11 to aid in securing or limiting the motion of the food item within the cavity 11.

Figure 1B:
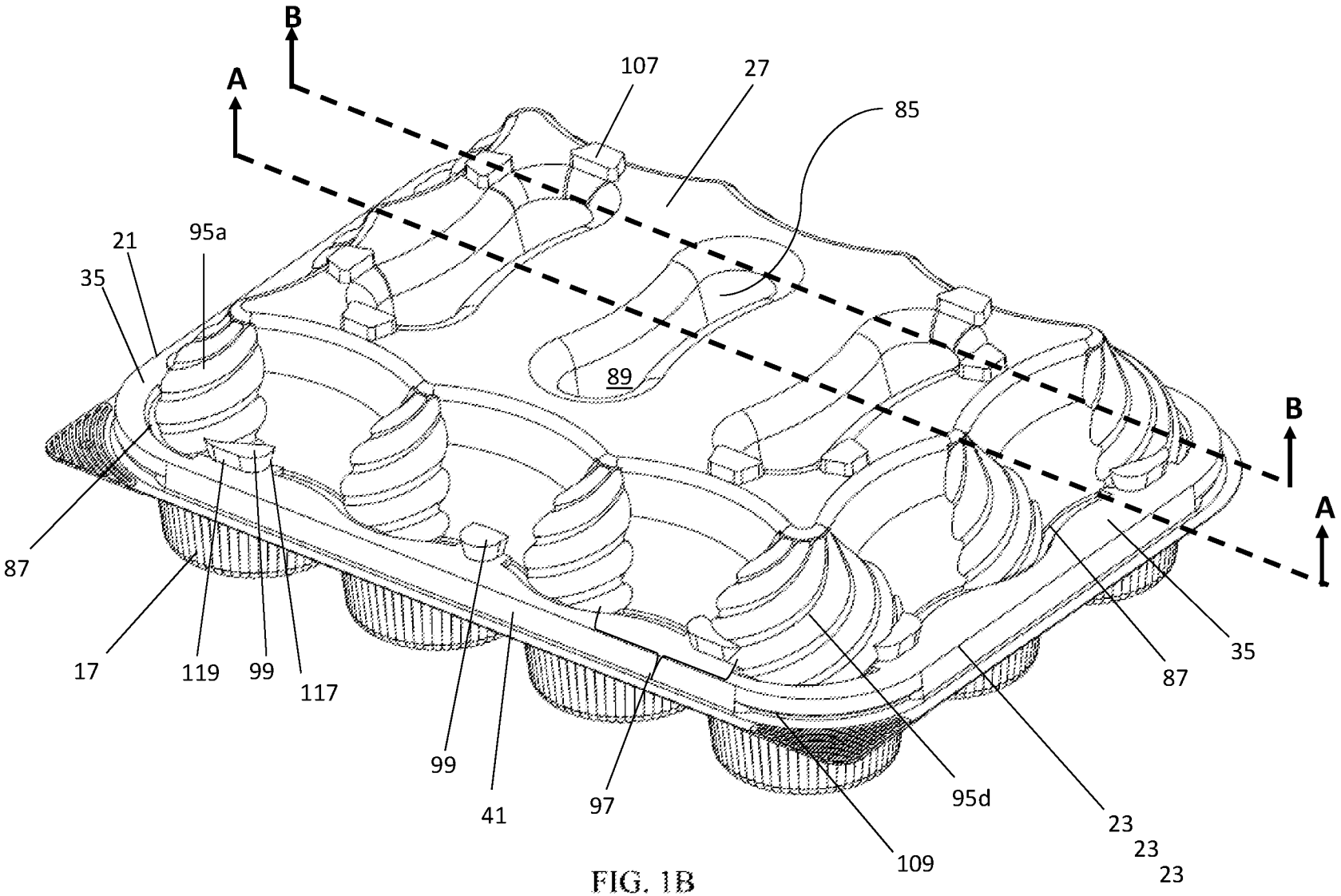
FIG. 1B is a perspective view of an exemplary embodiment of a container of the present disclosure with the lid portion closed on top of the base portion.
Figure 1C:
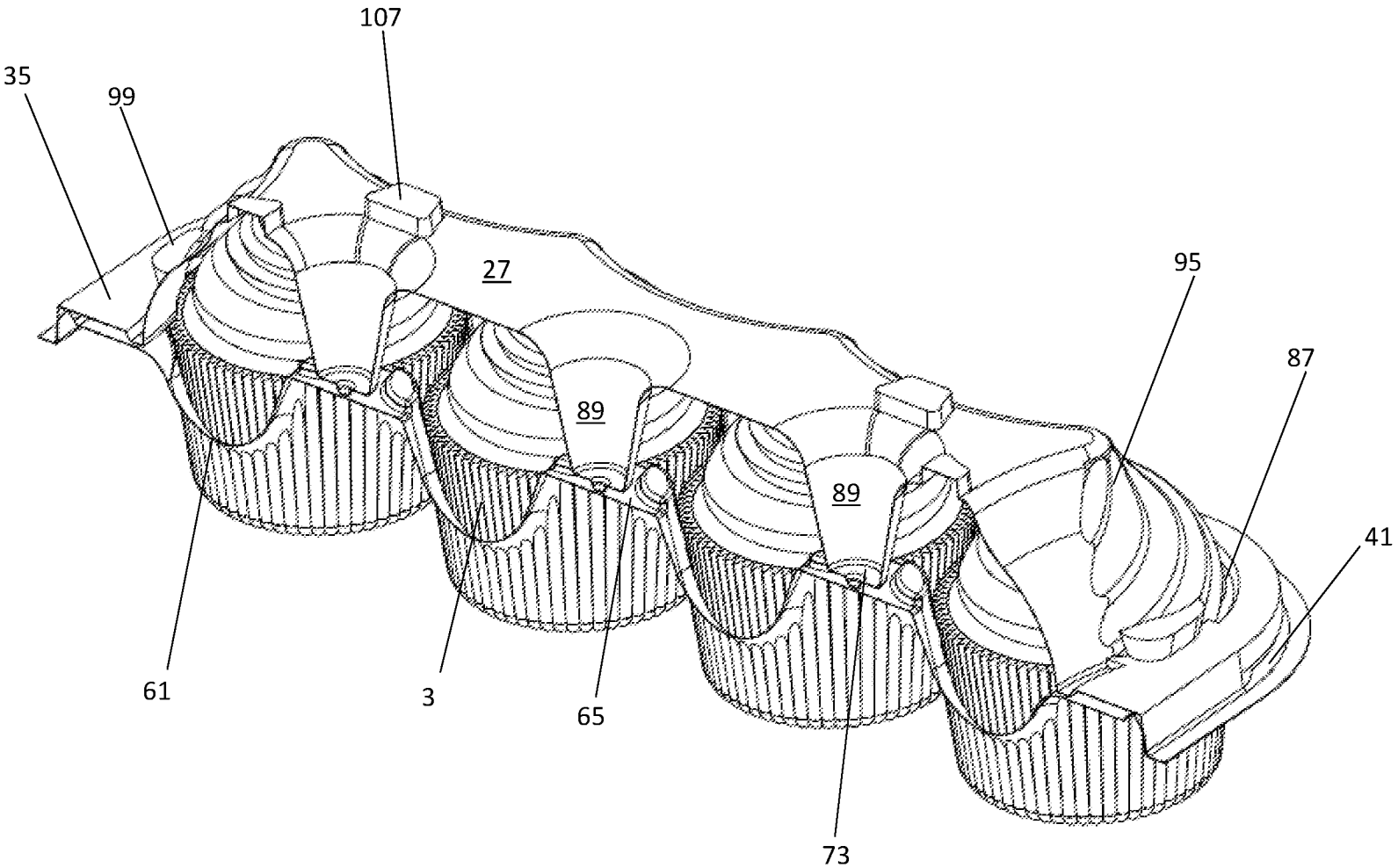
FIG. 1C is a cutaway perspective view along the line B-B of FIG. 1B.
Figure 1D:
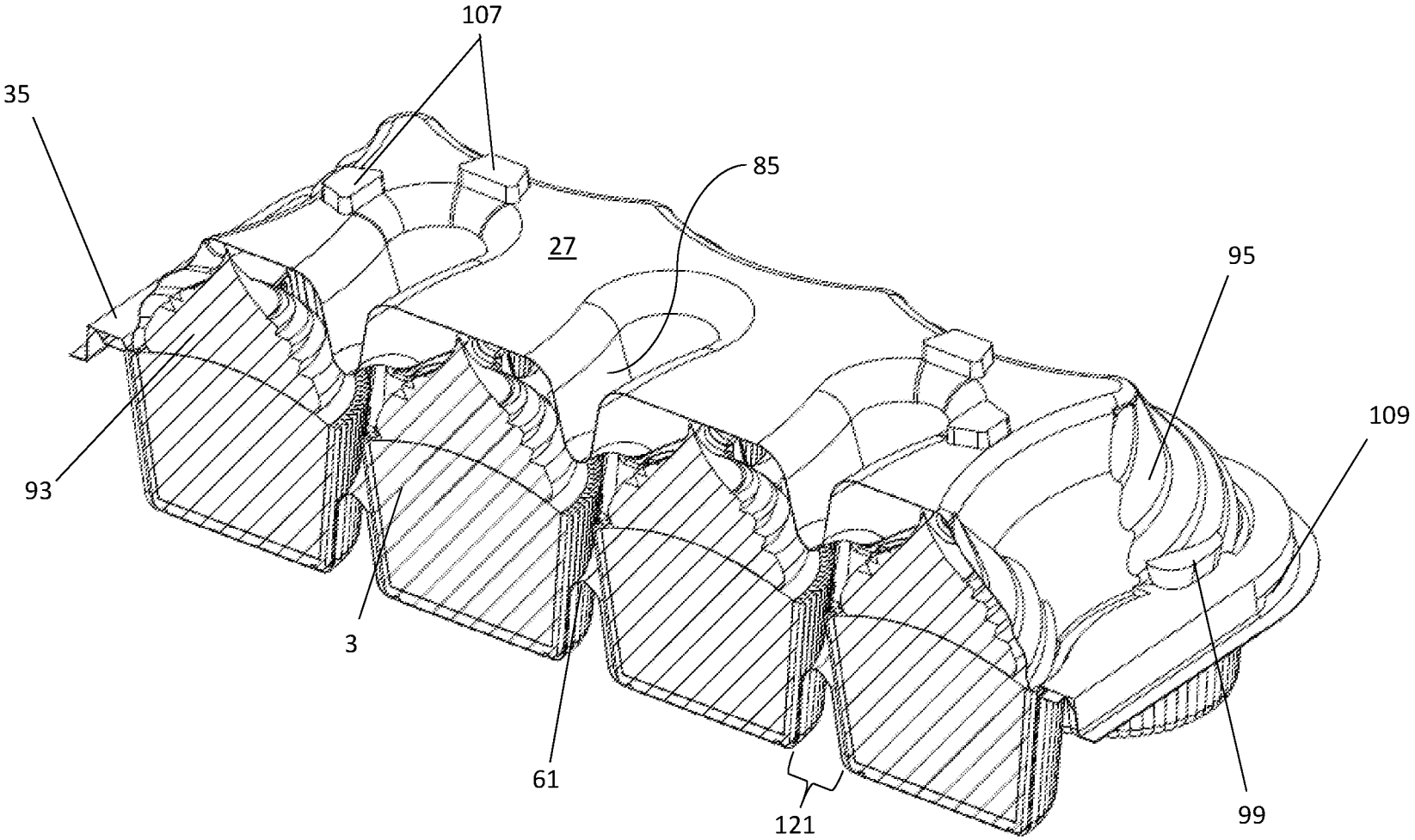
FIG. 1D is a cutaway perspective view along the line A-A of FIG. 1B.
Figure 2:
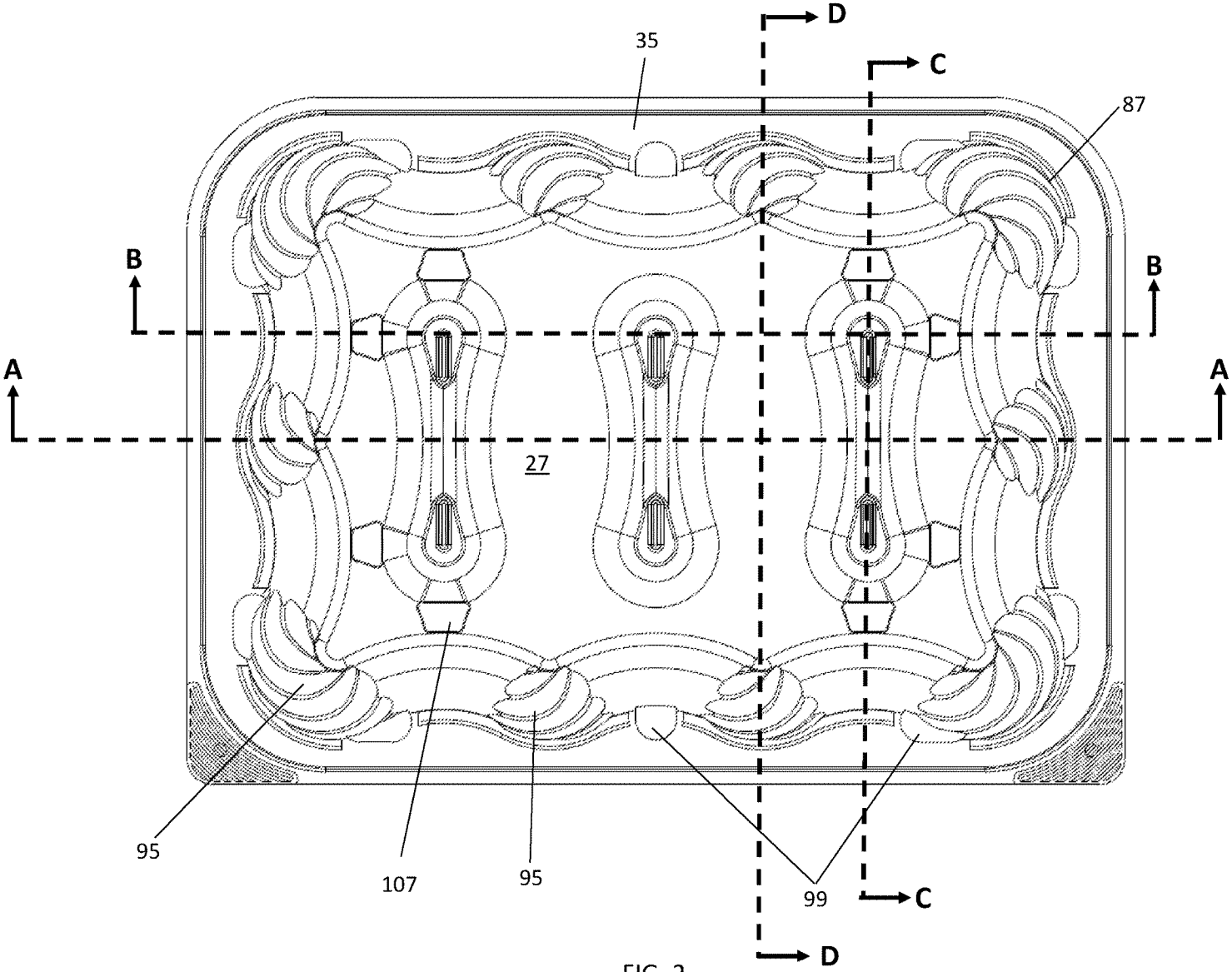
FIG. 2 is a top view of an exemplary embodiment of a container of the present disclosure.

Additionally, as shown in FIGS. 1B and 7B, the lid side wall can have a plurality of partial dome portions 95 that are configured to approximate the shape of the respective cavity 11. The domed portions 95 can have a bottom portion 101 and a top portion 103 with the lid sidewall 29 spanning between the top portion 103 and bottom portion. The side wall 29 between the top 103 and bottom 101 portions can be slightly rounded or domed. In some embodiment, the domed portion 95 can approximate the icing portion 93 of a cupcake within the interior of the container. Additionally, the space between the icing portion and the interior sidewall 27 of the domed portion can be less between about 0.1" inches and 1", about 0.2" and about 0.8", or less than about 0.5", or less than about 0.2". In some embodiments, the bottom end 101 can approximate between about 5% to about 60%, or between about 10% and about 40% of the cavity rim's 19 shape. In some embodiment, the partial dome portion 95 can include a swirl feature 105. The bottom end 101 of the dome portion 95 can also form a part of the internal lid peripheral edge 49 that can be used to aid in minimizing the movement of a food item within the cavity.

Figure 8:
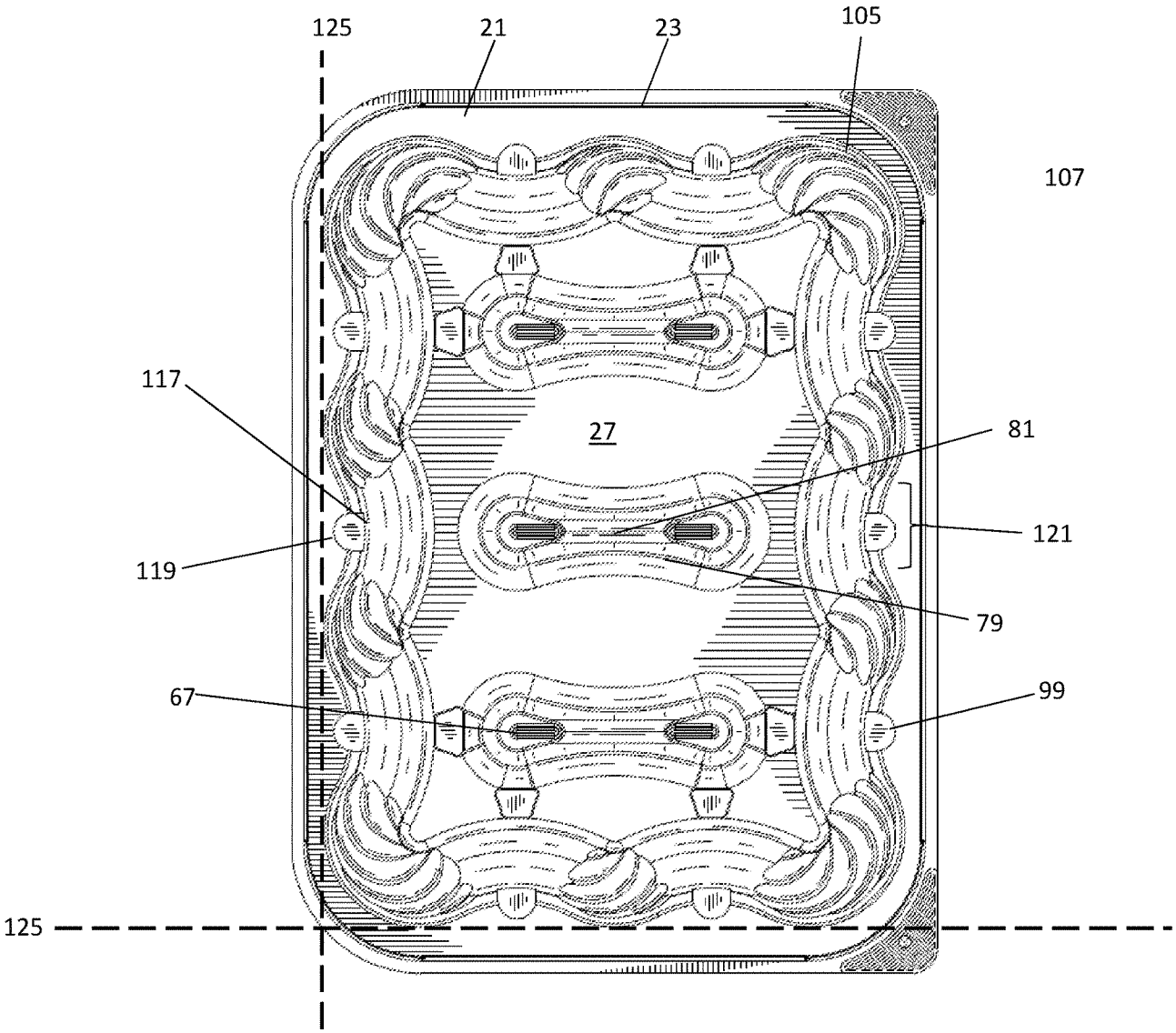
FIG. 8 is a top view of an exemplary embodiment of a container of the present disclosure.

The domed portions can form recessed areas 97 in between each of the dome portions on the lid portion 21. A de-nesting lug 99 can be located within a recessed area 97 formed by a dome portion. The de-nesting lug 99 can have a first end 117 and a second end 119. The first end 117 can be proximate or formed into a portion of the lid side wall 29, as shown in FIG. 1B. The second end 119 can extend out from the side wall 29 a pre-determined distance. In some exemplary embodiments, the second end 119 will not extend past the domed portion plane/edge 125 as shown in FIG. 8. The domed portion plane/edge 125 can runs down each of the four sides of the lid portion.

Figure 9:
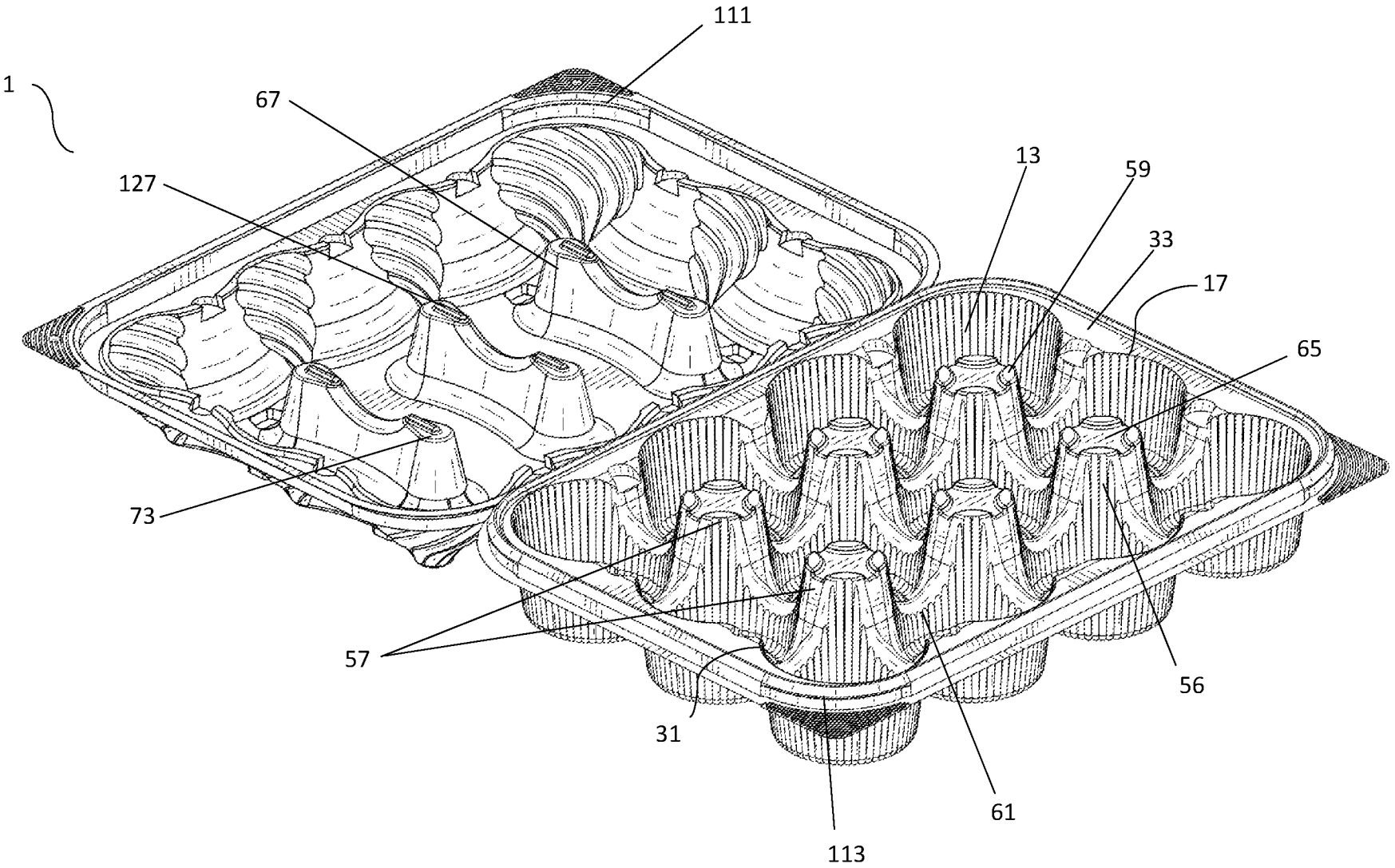
FIG. 9 is a perspective view of an exemplary embodiment of a container of the present disclosure.

FIG. 9 illustrates two dashed lines to represent the plane 125 for illustrative purposes, but it should be understood that this plane exists on the other sides of the container 1. On the exterior side of the plane 125 the base peripheral edge surface is generally flat and free from obstructions. On the interior side of the plane 125 proximate the edge of the dome portions 95. In between the individual domed portions 95 one or more recessed areas 97 are formed which can provide a location for a de-nesting lug 99. As shown in FIG. 9, the plane 125 extends along a horizontal plane parallel on the base peripheral edge surface on all sides of the container 1. This helps ensure that de-nesting lugs 99 do not impede a sealing mechanism from sealing the edge of the container to allow for continuous movement sealing along the edge of the container. In other embodiments, the de-nesting lugs 99 will not extend all the way to the lid peripheral edge 23. The de-nesting lugs can be formed on the lid peripheral edge surface 35 and a predetermined distance away from the coupling means 37. By maintaining the de-nesting lugs 99 apart from the coupling means, the packaging has addition structural rigidity and the sealing members are better capable of forming a sealing relationship. Currently, traditional packaging methods used to seal containers with de-nesting lugs requires a pressing means to press the top lid of a container to seal the container. This method of closing the container Additionally, by moving the de-nesting lugs 99 away from the peripheral edge of the lid, packaging and sealing efficiency and reliability of the containers can be greatly improved by allowing for a continuous movement sealing means during the packaging process rather than requiring an indexing motion to depress the lid portion 21 on the base portion 5 of the container 1. Currently, this indexing motion requires pressure to be applied to the top surface of the lid, which could potentially lead to crushing of contents within the container or not ensure full closure of the container lid to the base resulting in production delays and inefficiencies. In one exemplary embodiment, a packaging method can use a line conveyor and minimizer to ensure a closure at the peripheral edge of the package using continuous movement. The lid peripheral edge surface 35 can extend away from the cavities and past the domed portion plane/edge 125. By keeping the peripheral edge surface 35 free from de-nesting lugs, the sealing means, such as a minimizer is not obstructed from continually sealing the container down the entire edge of the container.

This eliminates current bottlenecks in the packaging process of the cupcake containers and also improves the reliability of the closure of the lid on the base of the container. The location of the de-nesting lugs within the recessed area 97 allows for a clean lid peripheral edge 23 and closure surface of the coupling means 37 to allow for continuous movement sealing down a line or conveyor. In some embodiments, the de-nesting lugs 99 can be located in all of the recessed areas 99. Alternatively, multiple configurations of the de-nesting lugs 99 can be used to allow for easy separation of the containers when multiple container are stacked together. This improves efficiency in the assembly and packaging by ensuring multiple containers do not remain stacked together or nested during packaging.

The relocation of the de-nesting lugs 99 to spaces 121 between the cavity domes is unique to the industry, and provides greater value through manufacturing efficiency improvements, improved closure reliability and removes the need for indexing motion (i.e. stop and go) during the packaging of the food items within the container. The new de-nesting lug 99 location feature is accomplished through reconfiguring the geometry (i.e. inward curves/spaces 121 between product cavities) created through shaping each cavity lid outer vertical surface when shaping the package to resemble the product itself. By engineering the lid sidewall to contour to the food cavities, a recess/space 121 is formed to create a location for the de-nesting lugs 99 away from the perimeter edge of the package/container. Relocating the de-nesting lugs 99 inside the inward curves 121 allows continuance movement for the manufacturing line, and more specifically the package closure section of the production line.

According to yet another aspect of the present disclosure, a method of preparing a packaged food container for display comprising the steps of preparing a plurality of food items. The food items can then be loaded into the respective cavities of the container. The container may have a lid with at least one stacking lug 107 and one de-nesting lug 99 where the de-nesting nesting lug is located proximate to the recessed area 97 within the area between the domed portion plane 125 and the recessed areas 97 as shown in FIG. 8. After the food items 3 are placed within the food cavities of the container the lid can be placed on top of the base portion of the container which can then be ran through a sealing means, such as a reducer, to seal the lid portion to the base portion of the container.

The container 1 can further include stacking lugs 107. In one exemplary embodiment, the stacking lugs 107 can be on the upper lid surface 27. The upper lid surface 27 can be located proximate to the corners of the upper lid surface 27. The stacking lugs 107 can be configured to fit in the spaces 121 formed between the cavities 11 of the base portion 5.

The container 1 of the present disclosure can come in any suitable configuration for holding food items. Referring to FIG. 1A, one exemplary embodiment of the present disclosure can have a cavity configuration of 3×4 to allow for the container to have twelve cavities for holding 12 different food items. It should be understood, that the container can be configured to have various numbers of cavities in various layouts, including but not limited to, 1×2, 1×3, 2×2, 2×3, 3×3, 3×4, 4×4, 4×5, 2×6, 5×5, 3×6, 4×6, 5×6, and 6×6. Similarly, in one embodiment, 3 cavities can surround a single interior support member to form a triangular arrangement within the container. The container can be made from any suitable material such as PVC, PET, poly propylene, poly propylene with clarifier, PLA, and other suitable plastics and polymers. Similarly, the polymer can be translucent/transparent, or may have a color or opaque depending upon the desired use of the container.

In some embodiments, the lid portion 21 and the base portion 5 can be hingedly connected to each other along a peripheral edge of the respective portions. A hinge 115 can connect the two portions along a hinge axis. In come exemplary embodiments, the hinge can be perforated in nature to allow a user to separate the lid portion 21 from the base portion 5. This is advantageous for situations where the food items 3 will be displayed and do not required to be constantly covered. The lid portions 21 can still be coupled to the base portions 5 after separating the portions from the hinge via the coupling means 37.

What has been described above has been intended to be illustrative of the invention and non-limiting. Modifications may be made without departing from the scope of the invention as defined in the claims appended hereto.

INDEX OF ELEMENTS

1—container
3—food item(s)
5—base portion
7—base peripheral edge
9—base peripheral edge plane
11—cavity
13—cavity interior wall surface
15—cavity base wall
17—a first portion of the cavity interior wall surface
19—cavity rim
21—lid portion
23—lid peripheral edge
25—lid peripheral edge plane
27—upper lid surface
29—lid sidewall
31—continuous exterior cavity rim portion
33—base peripheral edge surface
35—lid peripheral edge surface
37—coupling means
39—base sealing member
41—lid sealing member
43—lip
45—first portion of base sealing member
47—second sealing portion of base sealing member
49—internal lid peripheral edge
51—upper channel edge
53—first portion of lid sealing member
55—second portion of lid sealing member
56—second portion of the cavity interior wall surface
57—interior support members
59—top surface of the interior support member
61—recessed portion of interior wall surface
63—intermediate portions
65—top surface groove/channels
67—lid support member
69—first portion of lid support member on bottom surface
71—interior support member plane
73—bottom surface of lid support member
75—exterior surface
77—interior surface
79—lid support member side wall
81—bridge portion
83—arched portion
85—lid cavity
87—channel
89—cavity wall
91—intermediate portion plane
93—icing portion of the food item
95—dome portions
97—recessed area
99—de-nesting lug
101—bottom end of partial dome portions
103—top end of partial dome portions
105—swirl feature
107—stacking lug
109—groove feature
111—lid groove
113—base groove
115—hinge
117—de-nesting first end
119—de-nesting second end
121—spaces/curves/recesses
123—bottom edge of coupling means plane
125—domed portion plane/edge

What is claimed is:

1. A container for storing a plurality of food items, comprising:

a base portion having a peripheral edge surface defining a base peripheral edge plane;

a plurality of cavities in the base portion, each cavity having an interior wall surface extending up a first axis from a cavity base wall, wherein at least a first portion of the interior wall surface terminates at a cavity rim formed where the first portion of the interior wall surface intersects with the peripheral edge surface, wherein an exterior cavity rim portion is formed by the plurality of cavities;

a lid portion configured to removably couple to the base portion, wherein the lid portion has a lid peripheral edge surface defining a lid peripheral edge plane, an upper lid surface, and a lid sidewall extending down an axis from the upper lid surface to the lid peripheral edge surface, wherein the lid comprises an internal peripheral lip edge that approximates an entire base interior edge, wherein the internal lip extends planarly past an edge of the cavity rim portion and overlies a portion of the cavity, the internal peripheral lip edge defining a portion of a channel on an exterior surface of the lid portion, the lid peripheral edge surface configured to extend from an upper edge of the channel until terminating at the peripheral lip edge surface, wherein the channel runs along a portion of a perimeter of the lid peripheral edge surface;

wherein the lid portion comprises at least one de-nesting lug;

at least two interior support members formed within the base portion, wherein each of the at least two interior support members comprises grooves; and at least two lid support members formed within the lid portion, wherein the at least two lid support members are coupled together by a bridge portion and extending down from the upper surface of the lid portion, wherein each of the two interior support members are configured to couple to each of the lid support members, wherein the grooves are configured to allow for movement of the lid support members.

2. The container of claim 1, wherein the internal peripheral lip edge approximates at least a portion of the exterior cavity rim portion.

3. The container of claim 2, wherein the exterior cavity rim portion is continuous, and the internal peripheral lip edge approximates and extends along a length of the continuous exterior cavity rim portion.

4. The container of claim 1, wherein one or more de-nesting lugs are located in one or more recesses formed between domed portions of the lid sidewall, wherein the de-nesting lug does not extend all the way to the lid peripheral edge.

5. The container of claim 1, wherein the base portion and lid portion are coupled together along the base peripheral edge and the lid peripheral edge to form a hinge.

6. The container of claim 1, wherein a portion of the cavity interior wall surface extends to a second plane below the peripheral edge plane.

7. The container of claim 3, wherein a portion of the cavity interior wall surface extends above the peripheral edge plane to a third plane.

8. The container of claim 1, wherein one or more de-nesting lugs having a first end and a second end are located in one or more recesses formed between domed portions of the lid sidewall, wherein the second end of the de-nesting lug does not extend past a domed portion plane.

9. The container of claim 1, wherein the base peripheral edge further comprises a coupling means.

10. The container of claim 1, wherein the plurality of cavities are circular and form a cavity rim.

11. The container of claim 8, wherein at least a portion of the interior wall surface of at least one of the cavities terminates at the peripheral edge plane, and the lid peripheral edge plane is configured to allow for coupling between the base portion and lid portion using a continuous line sealing means.

12. The container of claim 1, wherein the cavity rim is on the same plane as the base peripheral edge plane.

13. The container of claim 1, wherein the internal peripheral lip edge is formed between the lid peripheral edge and the lid sidewall, wherein the internal peripheral lip edge is configured to protrude below the lid peripheral edge plane and extend outwardly over the cavity rim, wherein the internal peripheral lip edge is configured to restrict the movement of a food item within the cavity.

14. The container of claim 1, wherein the lid support member extends up from the base portion to an interior support member plane and a portion of the interior support member forms a part of the interior wall surface of each of the plurality of cavities.

15. The container of claim 14, wherein the interior support member plane is above the peripheral edge plane and configured to maintain a food item within the cavity and inhibit the movement of the food item from moving out of the prescribed cavity of the food item.

16. The container of claim 1, further comprising a lid sealing member and a base sealing member, wherein the lid sealing member and the base sealing member approximate one another around at least a portion of the lid and the base peripheral edge surfaces.

17. The container of claim 16, wherein a first portion of the lid sealing member extends downward from the lid peripheral edge surface and a second portion of the lid sealing member extends horizontally planar from the first portion of the lid sealing member; and wherein a first portion of the base sealing member extends upward from the base peripheral edge surface and a second portion of the base sealing member extends down from a lip located at the base peripheral edge surface.

18. The container of claim 17, wherein the second portion of the base sealing member extends below the base peripheral edge plane.

* * * * *